US009568854B2

(12) United States Patent
Takeuchi et al.

(10) Patent No.: US 9,568,854 B2
(45) Date of Patent: Feb. 14, 2017

(54) IMAGE FORMING APPARATUS CONFIGURED TO EXECUTE REMOVAL CONTROL

(71) Applicant: CANON KABUSHIKI KAISHA, Tokyo (JP)

(72) Inventors: Kosuke Takeuchi, Abiko (JP); Yasushi Takeuchi, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/820,913

(22) Filed: Aug. 7, 2015

(65) Prior Publication Data

US 2016/0054675 A1 Feb. 25, 2016

(30) Foreign Application Priority Data

Aug. 21, 2014 (JP) ..... 2014-168103

(51) Int. Cl.
*G03G 15/06* (2006.01)
*G03G 15/095* (2006.01)

(52) U.S. Cl.
CPC ..... *G03G 15/065* (2013.01); *G03G 15/095* (2013.01); *G03G 2215/0648* (2013.01)

(58) Field of Classification Search
CPC ..... G03G 15/065; G03G 15/095
USPC ..... 399/55, 264, 269
See application file for complete search history.

(56) References Cited

U.S. PATENT DOCUMENTS 3,543,720 A * 12/1970 Altmann ..... G03G 15/09 399/264
4,493,882 A * 1/1985 Kaneko ..... G03G 15/095 430/119.81
5,911,098 A * 6/1999 Gyotoku ..... G03G 15/0803 399/264
5,923,933 A * 7/1999 Anzai ..... G03G 15/09 399/269
7,260,347 B2 * 8/2007 Tamaki ..... G03G 15/0907 399/269

(Continued)

FOREIGN PATENT DOCUMENTS

JP 2000-305352 A 11/2000
JP 2004-029569 A 1/2004

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

Removal control performing both first and second control in series is performed. The first control involves rotating the plurality of developer bearing members in a state in which the developing bias is applied to the plurality of developer bearing members so that force acting on opposite-polarity particles from a normally charged toner in the direction of moving the particles from the developer bearing member toward the image bearing member. The second control involves rotating one developer bearing member at a faster circumferential velocity than the other developer bearing member in a state in which the developing bias is applied to the plurality of developer bearing members or the developing bias is turned off so that the force acting on the opposite-polarity particles from the normally charged toner in the direction of moving the particles from the developer bearing member toward the image bearing member.

14 Claims, 29 Drawing Sheets

(56) References Cited

U.S. PATENT DOCUMENTS

| | | | | |
|---|---|---|---|---|
| 7,903,990 | B2 * | 3/2011 | Bessho | G03G 15/065 399/187 |
| 8,532,545 | B2 * | 9/2013 | Hokkyoh | G03G 15/0818 399/149 |
| 9,026,011 | B2 * | 5/2015 | Kubo | G03G 15/0849 399/269 |
| 2006/0104674 | A1 * | 5/2006 | Tamaki | G03G 15/0907 399/269 |
| 2008/0240758 | A1 * | 10/2008 | Shaw | G03G 15/0806 399/55 |
| 2010/0086323 | A1 * | 4/2010 | Saito | G03G 15/0907 399/55 |
| 2012/0020688 | A1 * | 1/2012 | Yotsutsuji | G03G 15/0907 399/55 |
| 2014/0003827 | A1 * | 1/2014 | Arimura | G03G 15/5008 399/43 |
| 2014/0348557 | A1 * | 11/2014 | Hasegawa | G03G 15/2025 399/327 |
| 2015/0253689 | A1 | 9/2015 | Ishida et al. | |

* cited by examiner

IMAGE FORMING APPARATUS CONFIGURED TO EXECUTE REMOVAL CONTROL

BACKGROUND OF THE INVENTION

Field of the Invention

The present invention relates to an image forming apparatus that includes a developing device having a plurality of developer bearing members and forms an image according to an electrophotographic recording method or the like.

Description of the Related Art

Conventionally, an image forming apparatus such as a copying machine, a laser beam printer, a facsimile, or a printing apparatus which uses an electrophotographic system uniformly charges the surface of an image bearing member and performs image exposure with the aid of a semiconductor laser or an LED to thereby form an electrostatic latent image on the image bearing member. The electrostatic latent image is visualized as a developer image by a developing device. After that, this visible image is transferred to a transfer member, and the transferred visible image (developer image) is fixed to the transfer member by a fixing device and is output.

In recent years, the demand for improving the printing speed and the image quality of an image forming apparatus has increased, and a developing device provided in such a high-speed image forming apparatus that prints images at a high speed includes a plurality of developer bearing members that bears a developer.

Specifically, a developing device having a plurality of developer bearing members is proposed as disclosed in Japanese Patent Laid-Open No. 2000-305352 and Japanese Patent Laid-Open No. 2004-29569. The developing device disclosed in Japanese Patent Laid-Open No. 2000-305352 uses a magnetic mono-component developer as a developer.

More specifically, in the developing device, as illustrated in FIG. 1, a first developing sleeve 41*a* and a second developing sleeve 41*b* are disposed closely to each other in an opening of the developing device 4 having a developer stored therein, facing a photosensitive member 2.

The photosensitive member 2 rotates in the direction indicated by an arrow in the drawing and the first developing sleeve 41*a* and the second developing sleeve 41*b* rotates in the direction indicated by an arrow in the drawing. That is, when the first developing sleeve 41*a* is at a position near the photosensitive member 2, the moving direction of the photosensitive member 2 is the same as the moving direction of the first developing sleeve 41*a*. Moreover, when the second developing sleeve 41*b* is at a position near the photosensitive member 2, the moving direction of the photosensitive member 2 is the same as the moving direction of the second developing sleeve 41*b*. In a portion (hereinafter referred to as a "SS portion") where the first developing sleeve 41*a* and the second developing sleeve 41*b* face each other at a close distance, the moving direction of the first developing sleeve 41*a* is opposite to the moving direction of the second developing sleeve 41*b*.

The developer in the developing device 4 is conveyed to the vicinity of the second developing sleeve 41*b* by agitating and conveying members 44 and 45 and is further conveyed to the vicinity of the SS portion with rotation of the second developing sleeve 41*b* in the direction indicated by the arrow in the drawing. Here, when the developer passes through the SS portion, the thickness thereof is regulated by the first developing sleeve 41*a* and a developer layer is formed on the surface of the second developing sleeve 41*b*.

Although a portion of the developer layer closest to the photosensitive member 2 is provided for development, a developer which has not been provided for development is collected again into the developing device 4.

On the other hand, a developer which has not been born on the surface of the second developing sleeve 41*b* among the developer conveyed up to the vicinity of the SS portion is conveyed to the vicinity of a thickness regulating member 42 with rotation of the first developing sleeve 41*a* in the direction indicated by the arrow in the drawing. When the developer passes through a gap (hereinafter referred to as a "SB portion") between the thickness regulating member 42 and the first developing sleeve 41*a*, the thickness thereof is regulated by the thickness regulating member 42, and a developer layer is formed on the surface of the first developing sleeve 41*a*. Although a portion of the developer layer closest to the photosensitive member 2 is provided for development, a developer which has not been provided for development is conveyed to the SS portion in which the first developing sleeve 41*a* and the second developing sleeve 41*b* face each other at a close distance. A portion of the developer conveyed to the SS portion is collected into the developing device 4, and the remaining developer is conveyed to the second developing sleeve 41*b* to form a portion of the developer layer on the second developing sleeve 41*b*.

In such a system that performs development using a plurality of developing sleeves, when the developer layer of the first developing sleeve 41*a* is formed in the SB portion of the developing device, a portion of an external additive included in the developer is separated from the developer to accumulate in the SB portion as clusters of agglomerates. Further, a portion of the clusters of agglomerates accumulating in the SB portion passes through the SB portion at a certain time to reach the SS portion. These clusters of agglomerates having moved to the SS portion remain in a certain longitudinal position near the SS portion and accumulate gradually as illustrated in FIG. 2. The clusters of agglomerates accumulating in a certain amount or more inhibit formation of a coated layer of the second developing sleeve 41*b*. When formation of the coated layer of the second developing sleeve 41*b* is inhibited, the coated layer of the second developing sleeve becomes thinner than that of a portion where formation of the coated layer is not inhibited. When image formation is performed in this state, as illustrated in FIG. 2, an image defect which becomes a white stripe occurs on a halftone image at a position identical to the position where clusters of agglomerates accumulate in the longitudinal direction.

SUMMARY OF THE INVENTION

Therefore, an object of the present invention is to prevent clusters of agglomerates accumulating in a portion where a first developing sleeve and a second developing sleeve face each other at a close distance from inhibiting formation of a coated layer of the second developing sleeve and to prevent image defects resulting from clusters of agglomerates.

In order to attain the object, an image forming apparatus of the present invention includes: an image bearing member; a developing device having a first developer bearing member and a second developer bearing member disposed along a rotation direction of the image bearing member so as to bear a developer; a developing bias power supply configured to apply a developing bias to the first developer bearing member and the second developer bearing member; and a controller configured to execute removal control of performing both first and second control in series, the first control involving rotating the first developer bearing member and the second developer bearing member in a state in which the developing bias is applied to the first developer bearing member and the second developer bearing member so that force acting on opposite-polarity particles from a normally charged toner in the direction of moving the particles from each first developer bearing member and second developer bearing member toward the image bearing member during non-image formation is larger than that during image formation, and the second control involving rotating the first developer bearing member at a faster circumferential velocity than the second developer bearing member in a state in which the developing bias is applied to the first developer bearing member and the second developer bearing member or the developing bias is turned off so that the force acting on the opposite-polarity particles from the normally charged toner in the direction of moving the particles from each first developer bearing member and second developer bearing member toward the image bearing member is smaller than that during the image formation or becomes zero, or force is applied to the opposite-polarity particles from the normally charged toner in the direction of moving the particles from the image bearing member toward the developer bearing member.

According to the present invention, it is possible to prevent clusters of agglomerates accumulating in a portion where a first developing sleeve and a second developing sleeve face each other at a close distance from inhibiting formation of a coated layer of the second developing sleeve and to prevent image defects resulting from clusters of agglomerates.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the accompanying drawings. It should be noted that features such as dimensions, materials, shapes, relative arrangements, and the like of components described in the following embodiments may be appropriately changed depending on a configuration and various conditions of an apparatus to which the present invention is applied. Thus, these features are not intended to limit the scope of the invention unless specifically stated otherwise.

Hereinafter, embodiments of the present invention will be described with reference to the drawings. Although this developing device is used in an image forming apparatus described below, for example, the present invention is not limited to this embodiment. Redundant description of the portions described in the section "Description of the Related Art" will not be provided.

[First Embodiment]

<Image Forming Apparatus>

Figure 3:
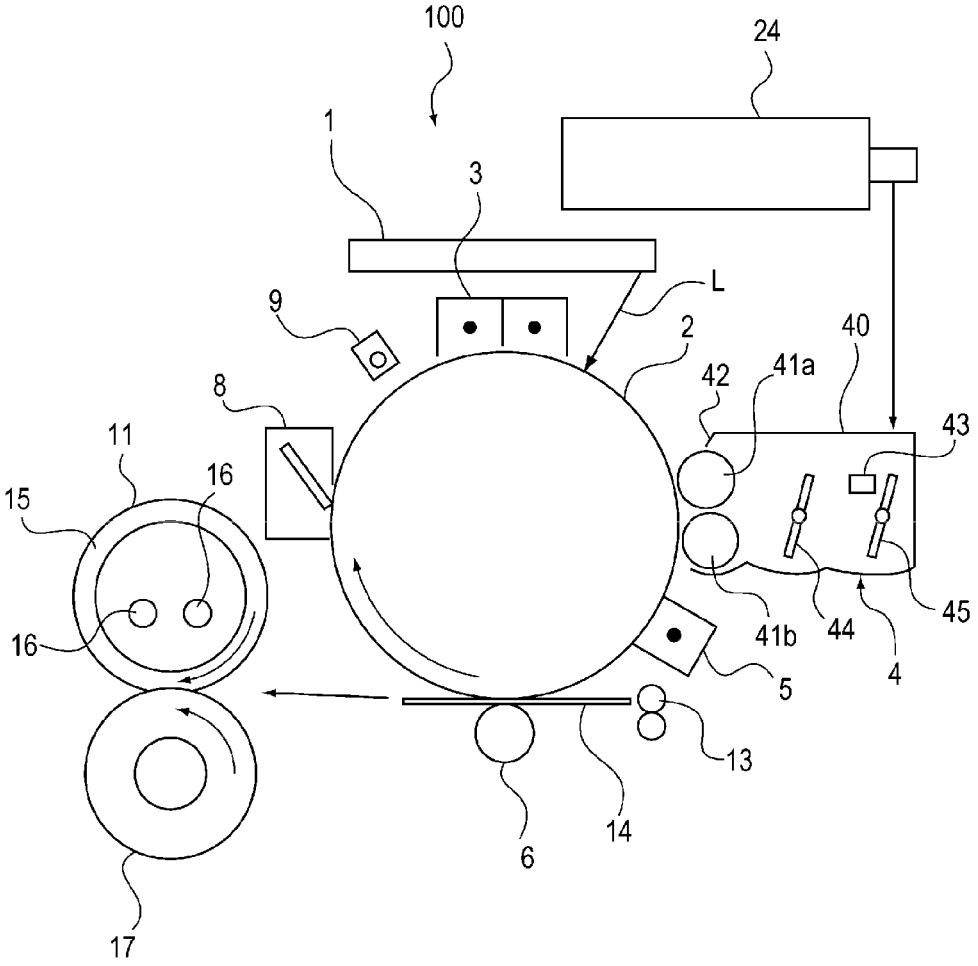
FIG. 3 is a schematic configuration diagram illustrating an image forming apparatus having a developing device.

FIG. 3 is a schematic configuration diagram illustrating an image forming apparatus 100 (in the present embodiment, an image forming apparatus such as an electrophotographic system laser beam printer) according to the present embodiment.

The image forming apparatus 100 according to the present embodiment includes a photosensitive member 2 as an image bearing member that is rotated in a direction (clockwise direction) indicated by an arrow. A primary charger 3, a developing device 4, a pre-transfer charger 5, a transfer roller 6, a cleaning device 8, and a neutralization exposure lamp 9 are arranged around the photosensitive member 2 in that order in the rotation direction of the photosensitive member 2. An exposure device 1 is arranged above the developing device 4. Moreover, a fixing device 11 is disposed on a downstream side of the transfer roller 6 in relation to the conveying direction (the direction indicated by an arrow) of a transfer member (sheet) 14.

An image forming operation of the image forming apparatus 100 will be described. During image formation, the photosensitive member 2 is rotated at a predetermined circumferential velocity (process speed) in the direction (clockwise direction) indicated by the arrow by a driving device (not illustrated), and the surface of the photosensitive member 2 is charged with a predetermined polarity and potential by the primary charger 3 to which a charging bias is applied. In the present embodiment, the process speed is 500 mm/s.

When an image exposure beam L corresponding to image information is applied from the exposure device 1 to the surface of the charged photosensitive member 2, the potential of an exposed portion on the surface of the photosensitive member 2 decreases and an electrostatic latent image corresponding to the input image information is formed. The developing device 4 allows toner charged with the same polarity as the charged polarity of the photosensitive member 2 to adhere to the electrostatic latent image to visualize the electrostatic latent image as a toner image.

An a-Si photosensitive member having an outer diameter of 108 mm is used as the photosensitive member 2. Moreover, in a transfer portion, a conductive spongy rubber roller having an outer diameter of 20 mm and hardness of 30□ (a value read with Asker-C after the elapse of five seconds under a load of 500 gf) is used as the transfer roller 6. The transfer member 14 waiting in a registration controller 13 is conveyed to the transfer portion at a predetermined time. At a transfer position (transfer portion) at which the photosensitive member 2 faces the transfer roller 6, a constant current 60 μA is applied to the transfer roller 6, whereby the toner image is transferred from the photosensitive member 2 to the transfer member 14. The transfer member 14 to which the toner image is transferred is conveyed up to the fixing device 11 by a conveying apparatus (not illustrated).

The fixing device 11 includes a fixing roller 15 and a pressure roller 17, and a halogen heater 16 serving as a heating source is disposed in the fixing roller 15. The temperature of the fixing roller 15 is controlled to a certain temperature by the halogen heater 16. The transfer member 14 is conveyed to a fixing nip portion formed by the fixing roller 15 and the pressure roller 17 and is heated and pressurized in the fixing nip portion whereby the toner image is fixed to the transfer member 14, which is then discharged to the outside.

On the other hand, transfer-residual toner remaining on the surface of the photosensitive member 2 after the transfer is removed and collected by the cleaning device 8. Moreover, the charge remaining on the surface of the photosensitive member 2 is removed by the neutralization exposure lamp 9 to prepare for the next image forming operation.

[Control of Video Count]

Figure 4:
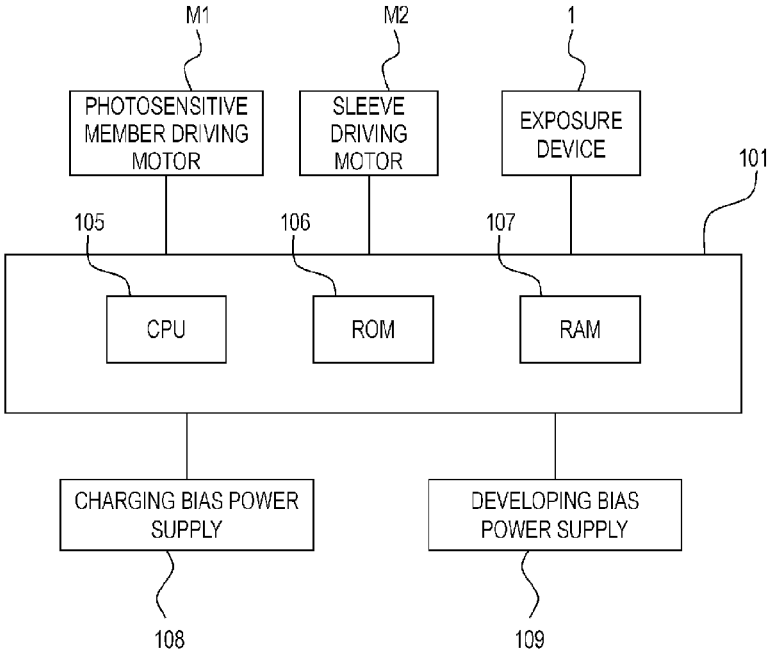
FIG. 4 is a block diagram of an entire image forming apparatus according to a first embodiment.

In this case, the image to be formed is subjected to digital processing so that an image ratio (a pixel number ratio (%) of image data when a sheet passes) of each sheet can be calculated and integrated. This information is transmitted to a CPU 105 and integrated in RAM 107 as illustrated in FIG. 4. The details thereof will be described in a fourth embodiment.

<Developing Device>

The developing device 4 has a simple configuration and does not require maintenance up to 1,500,000 times of printing which is the service life of a developing sleeve which is a developer bearing member. Moreover, as illustrated in FIG. 3, the developing device 4 includes one developer storage member 40, a plurality of developing sleeves 41*a* and 41*b* rotating in the same direction as indicated by arrows, and agitating and conveying members 44 and 45. When the amount of toner in the developing device 4 decreases with a repetition of image formation, a controller (not illustrated) supplies toner from a toner supply device 24 to the developing device 4 based on a signal from a piezoelectric element 43.

The supplied toner is conveyed up to the developing sleeves 41*a* and 41*b* by the agitating and conveying members 44 and 45 so that an image forming operation can be continued. Here, the two developing sleeves 41*a* and 41*b*, cylindrical members formed of A6063 having a diameter of □20, which are non-magnetic members, are subjected to surface processing, and are coated with carbon, and which have surface roughness Ra of 0.95 μm. The surface roughness was measured using a contact surface roughness meter (Surfcorder (trademark) SE-3300 manufactured by Kosaka Laboratory Ltd.) under conditions of a cut-off value of 0.8 mm, a measurement length of 2.5 mm, a feeding speed of 0.1 mm/s, and a vertical magnification of 5000 times.

Figure 1:
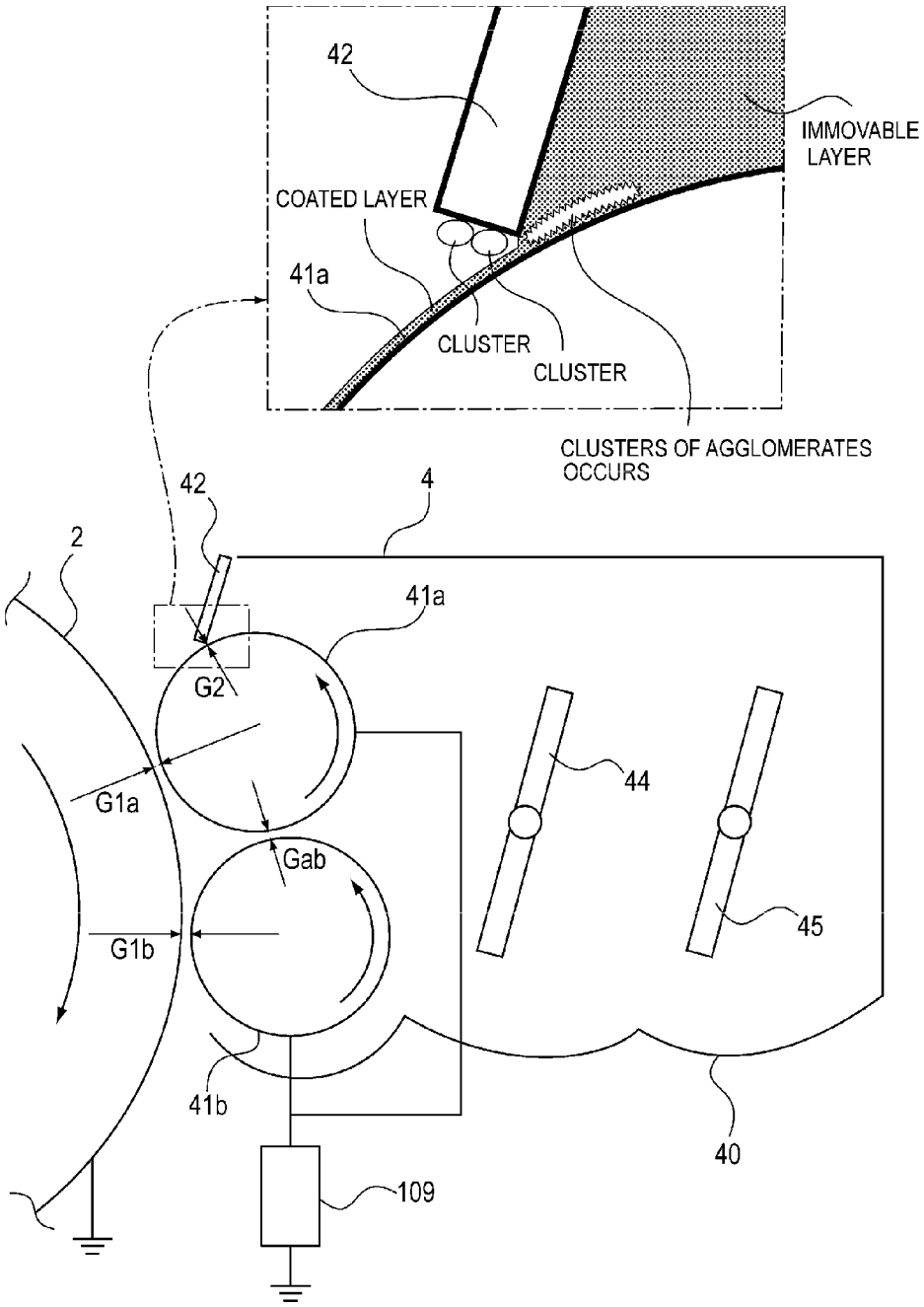
FIG. 1 is a schematic diagram illustrating a schematic configuration of a developing device and a portion where clusters of agglomerates occur.

The first developing sleeve 41*a* which is a developer bearing member (first developer bearing member) on the upstream side in the rotation direction of the photosensitive member 2 includes seven fixed permanent magnets (not illustrated) and the second developing sleeve 41*b* which is a developer bearing member (second developer bearing member) on the downstream side includes five fixed permanent magnets (not illustrated). As illustrated in FIG. 1, the thickness G2 of the toner near the first developing sleeve 41*a* is regulated to a predetermined thickness (in this example, 0.23 mm) by the thickness regulating member (magnetic planar member) 42. On the other hand, the thickness of the toner near the second developing sleeve 41*b* is decreased by the action of the N poles of the permanent magnets of the first developing sleeve 41*a* and the S poles of the permanent magnets of the second developing sleeve 41*b*.

As illustrated in FIG. 1, the first developing sleeve 41*a* and the second developing sleeve 41*b* are disposed closely to each other in a non-contacting manner in an opening of the developing device 4 having a developer stored therein, facing the photosensitive member 2. The gap Gab between the first and second developing sleeves 41*a* and 41*b* is 0.25 mm. Moreover, the first and second developing sleeves 41*a* and 41*b* are disposed so as to face each other at a close distance in relation to the photosensitive member 2 along the rotation direction thereof so as not to make contact with the photosensitive member 2. The gap between the first developing sleeve 41*a* and the photosensitive member 2 is indicated by G1*a* and the gap between the second developing sleeve 41*b* and the photosensitive member 2 is indicated by G1*b*. These gaps G1*a* and G1*b* are maintained by a spacer roller (not illustrated) arranged concentrically with the first and second developing sleeves 41*a* and 41*b*.

The photosensitive member 2 rotates in the direction indicated by an arrow in the drawing and the first and second developing sleeves 41*a* and 41*b* rotate in the direction indicated by an arrow in the drawing. That is, when the first developing sleeve 41*a* is at a position near the photosensitive member 2, the moving direction of the photosensitive member 2 is the same as the moving direction of the first developing sleeve 41*a*. Moreover, when the second developing sleeve 41*b* is at a position near the photosensitive member 2, the moving direction of the photosensitive member 2 is the same as the moving direction of the second developing sleeve 41*b*. In a portion (hereinafter referred to as a "SS portion") where the first developing sleeve 41*a* and the second developing sleeve 41*b* face each other at a close distance, the moving direction of the first developing sleeve 41*a* is opposite to the moving direction of the second developing sleeve 41*b*.

The developer in the developing device 4 is conveyed to the vicinity of the second developing sleeve 41*b* by the agitating and conveying members 44 and 45 and is further conveyed to the vicinity of the SS portion with rotation of the second developing sleeve 41*b* in the direction indicated by the arrow in the drawing. Here, when the developer passes through the SS portion, the thickness thereof is regulated by the first developing sleeve 41*a* and a developer layer is formed on the surface of the second developing sleeve 41*b*. Although a portion of the developer layer closest to the photosensitive member 2 is provided for development, a developer which has not been provided for development is collected again into the developing device 4.

On the other hand, a developer which has not been born on the surface of the second developing sleeve 41*b* among the developer conveyed up to the vicinity of the SS portion is conveyed to the vicinity of a thickness regulating member 42 with rotation of the first developing sleeve 41*a* in the direction indicated by the arrow in the drawing. When the developer passes through a gap (hereinafter referred to as a "SB portion") between the thickness regulating member 42 and the first developing sleeve 41*a*, the thickness thereof is regulated by the thickness regulating member 42, and a developer layer is formed on the surface of the first developing sleeve 41*a*. Although a portion of the developer layer closest to the photosensitive member 2 is provided for development, a developer which has not been provided for development is conveyed to the SS portion in which the first developing sleeve 41*a* and the second developing sleeve 41*b* face each other at a close distance. A portion of the developer conveyed to the SS portion is collected into the developing device 4, and the remaining developer is conveyed to the second developing sleeve 41*b* to form a portion of the developer layer on the second developing sleeve 41*b*.

In FIG. 1, reference numeral 109 designates a developing bias power supply. In the present embodiment, the gaps G1*a* and G1*b* are set to 0.22 mm, and a DC bias and rectangular waves as an AC bias having an amplitude of 1100 V and a frequency of 2.8 kHz are applied from the developing bias power supply 109 to the gaps G1*a* and G1*b*.

On the other hand, the toner born on the first and second developing sleeves 41*a* and 41*b* is negatively charged and the weight average particle size thereof is 5.8 μm. A particle size distribution of the toner can be measured by various methods. In the present embodiment, the particle size distribution was measured in the following manner using the Coulter counter TA-II (trademark) manufactured by Beckman Coulter, Inc. That is, several droplets of surfactant was added to 1% NaCl aqueous solution as electrolyte, several mg of a sample was dispersed in the electrolyte using ultrasonic waves for several minutes, and a particle size distribution of the particles having the size of 2 to 40 μm having passed through an aperture of 100 μm was counted. As a toner binding resin, a styrene-based styrene acrylic copolymer, a styrene butadiene copolymer, a phenolic resin, polyester, and the like are generally used. In the present embodiment, a styrene acrylic copolymer and a styrene butadiene copolymer were used in the ratio of 8:2.

A charge control agent (generally included in toner but may be externally added) such as nigrosin, quaternary ammonium salt, triphenylmethane, imidazole, or the like is used for positive toner. In the present embodiment, two parts of triphenylmethane were included in the toner (in terms of 100 parts of resin component).

Moreover, so-called wax is included and dispersed in thermally-fixed toner, and polyethylene, polypropylene, polyester, paraffin, and the like, for example, are used as the wax. Since toner has magnetic properties, an iron oxide such as magnetite or ferrite is dispersed in the toner, and the amount is generally approximately 60 to 100 parts. Silica for imparting mobility to toner is externally added approximately in 0.1 to 5 parts by weight as an external additive. This silica is disposed between the toner particle and the first and second developing sleeves 41*a* and 41*b* to perform a function of alleviating the wear of the first and second developing sleeves 41*a* and 41*b*. Moreover, the silica also performs a function of preventing agglomeration of toner particles to accelerate replacement of toner particles which are in contact with the first and second developing sleeves 41*a* and 41*b* and which are not. Further, strontium titanate, cerium oxide, oxidation praseodymium, oxidation lanthanum, neodymium oxide, and the like may be externally added to the toner. These additives play the role of rubbing agents to the photosensitive member 2 and consequently provide the effect of rubbing and removing the toner adhering to the photosensitive member 2 in a film form.

During image formation, the first and second developing sleeves 41*a* and 41*b* are rotated at velocities 1.05 and 0.95 times the velocity (500 mm/s) of the photosensitive member 2, respectively. Due to this, an average charging amount at room temperature and humidity of the toner on the first developing sleeve 41*a* is +4 to +6 μC/g and the coating amount of 0.4 to 0.6 mg/cm$^2$. An average charging amount at room temperature and humidity of the toner on the second developing sleeve 41*b* is +3 to +5 μC/g and the coating amount of 0.3 to 0.6 mg/cm$^2$.

[Apparatus Configuration]

First, driving control of the image forming apparatus 100 will be described briefly by referring to FIG. 4. A controller 101 as a controller that performs this control includes a CPU 105, RAM 107, ROM 106, and the like. In the controller 101, the CPU 105 reads a program from the ROM 106 and executes the program to execute respective processes. The RAM 107 stores data and the like necessary when the CPU 105 executes a program. The RAM 107 stores the number of printed sheets X and a defined number of sheets Y subjected to backward rotation control, which are used in the control described later. The ROM 106 stores a control program that the CPU 105 executes in order to control the image forming apparatus.

A photosensitive member driving motor M1 that drives the photosensitive member 2, a sleeve driving motor M2 that drives the developing sleeves 41*a* and 41*b*, and an exposure device 1 that exposes the photosensitive member 2 according to image information are connected to the controller 101.

Further, a charging bias power supply 108 that applies a charging bias to the primary charger 3 that charges the photosensitive member 2, the developing bias power supply 109 that applies a developing bias to the developing sleeves 41*a* and 41*b*, and the like are connected to the controller 101.

In the controller 101, the CPU 105 stores data and the like necessary for the RAM 107 or reads a program from the ROM 106 and executes the program while using the stored data and the like to thereby control the operation of the image forming apparatus. That is, the CPU 105 controls the operation of the photosensitive member driving motor M1, the sleeve driving motor M2, the exposure device 1, the charging bias power supply 108, the developing bias power supply 109, and the like according to a control program. A control operation of removing clusters of agglomerates performed by the controller 101 will be described later.

[Bias Sequence During Image Formation→Backward Rotation]

Figure 5:
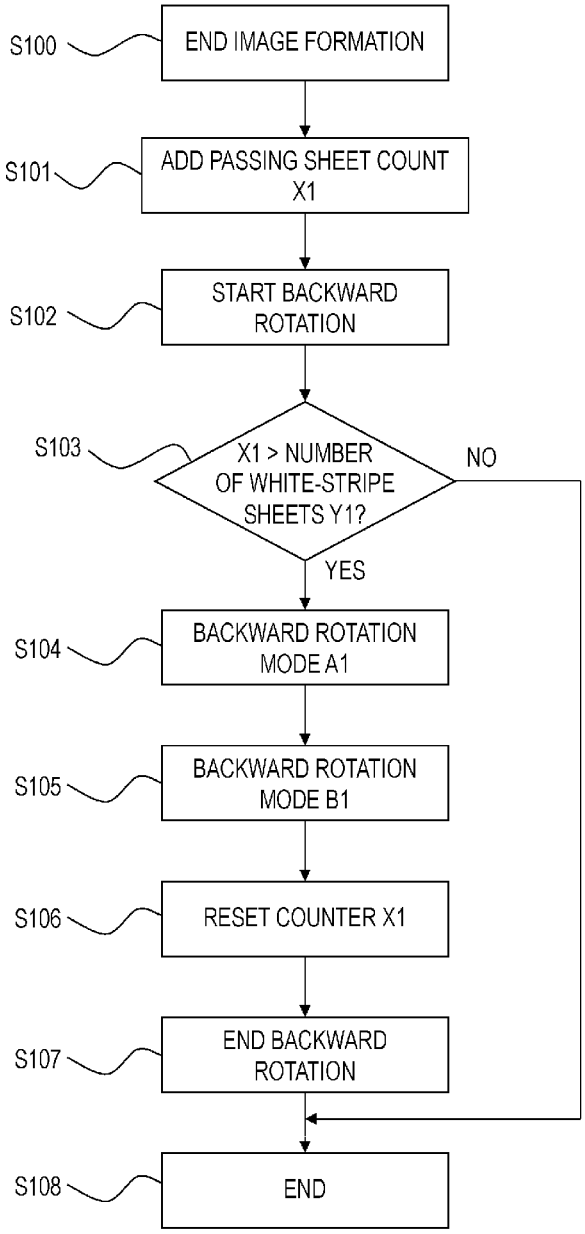
FIG. 5 is a flowchart illustrating the flow of a control operation according to the first embodiment.

FIG. 5 illustrates a control sequence used in the present embodiment. First, after image formation ends (S100), the count X of the number of passing sheets printed after previous removal control is performed is added (S101). After that, backward rotation starts (S102) and it is determined whether the number of passing sheets X exceeds a defined number of pages Y (in the present embodiment, 2,000 pages) (S103).

When it is determined in S103 that the number of passing sheets X exceeds the defined number of pages Y, the flow proceeds to S104 and backward rotation control A1 is performed as removal control of removing clusters of agglomerates between the first and second developing sleeves 41*a* and 41*b*. Subsequently, in S105, backward rotation control B1 is performed as the removal control. In this case, the execution time T1 of the backward rotation control A1 and B1 as the removal control is 60 seconds. After the backward rotation control A1 and B1 is executed, the passing sheet count X is reset (S106), and backward rotation ends (S107). The backward rotation control A1 and B1 as the removal control will be described later.

On the other hand, when it is determined in S103 that the number of passing sheets X is equal to or smaller than the defined number of pages Y, S104 to S106 are not performed (that is, the backward rotation control A1 and B1 as the removal control is not performed), and the flow proceeds to S107 to end backward rotation. After that, the entire image forming operation ends (S108).

[Description of Bias Control Value During Image Formation and Backward Rotation Control]

Next, bias control of the image forming apparatus 100 during the image formation (image formation mode) and backward rotation control described above will be described by referring to FIG. 6.

Figure 7:
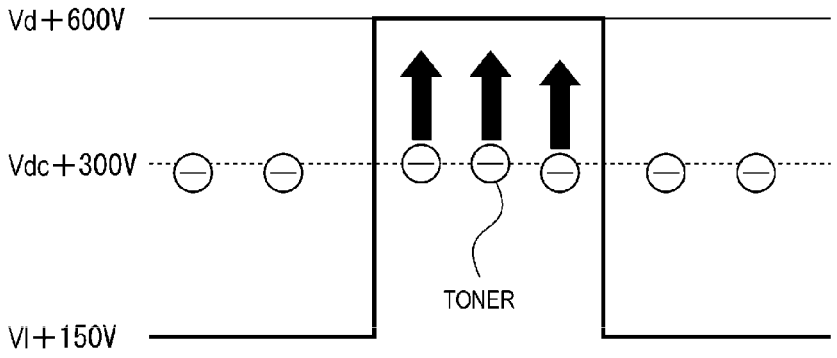
FIG. 7 is a diagram illustrating a movement of toner during normal image formation (image formation mode).

In the present embodiment, a BAE method is used and, as illustrated in FIG. 7, negatively charged toner moves toward a charging potential Vd of +600 V higher than an exposure potential Vdc of +300 V on the photosensitive member 2 whereby an image is formed. On the other hand, an exposing portion is a white background portion which is not exposed and the potential Vl on the photosensitive member 2 is 150 V lower than the exposure potential Vdc of 300 V.

During an image formation mode, the AC bias 1100 V (see image formation mode of FIG. 6) is added to the developing bias. In this state, the photosensitive member 2 is driven and the latent image on the photosensitive member is developed by toner and the developed toner image is transferred to a transfer member.

Figure 2:
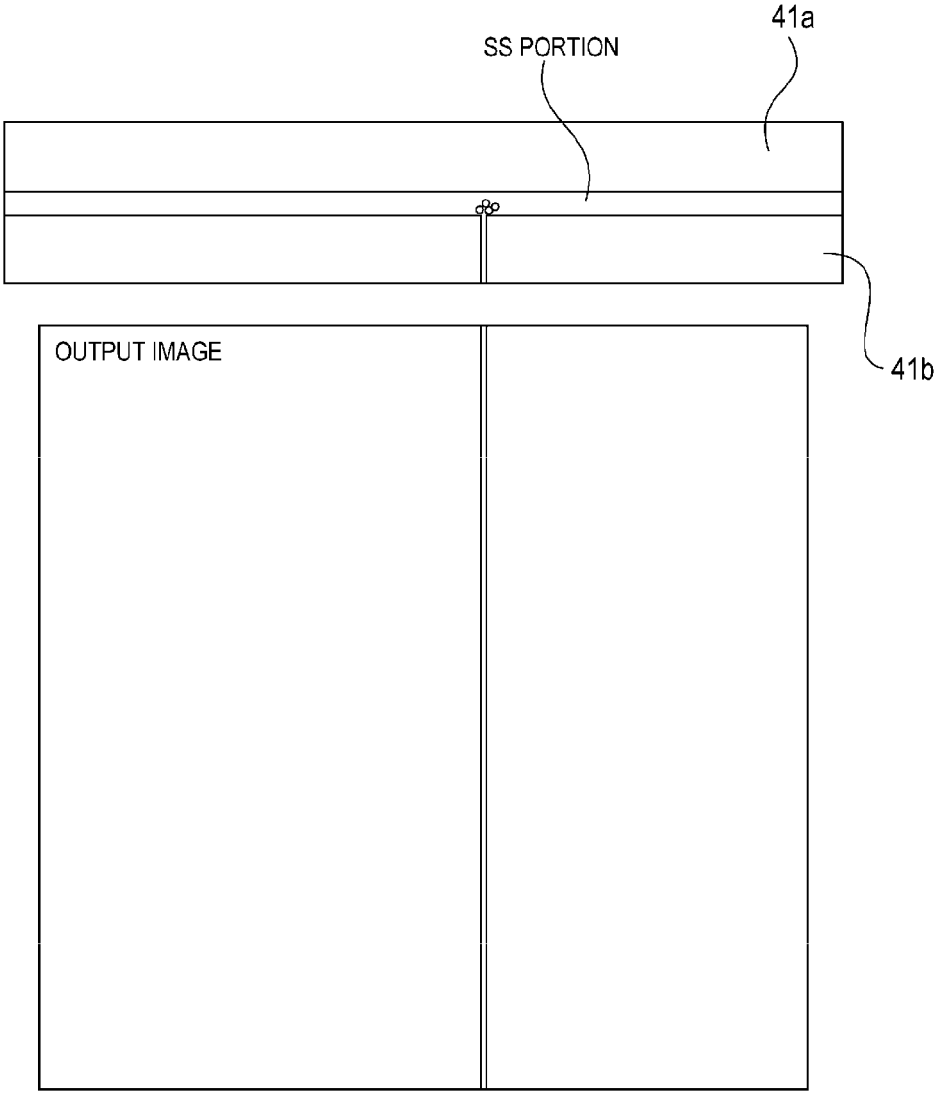
FIG. 2 is a schematic diagram illustrating the vicinity of a developing sleeve of a developing device and an output image.

In this case, as illustrated in FIG. 1, when the developer layer of the first developing sleeve 41*a* is formed in the SB portion of the developing device 4, a portion of the external additive included in the developer is separated from the developer and accumulates in the SB portion as clusters of agglomerates. Further, a portion of the clusters of agglomerates accumulating in the SB portion passes through the SB portion at a certain time to reach the SS portion. The clusters of agglomerates having moved to the SS portion remain in a certain longitudinal position near the SS portion and accumulate gradually as illustrated in FIG. 2.

Figure 6:
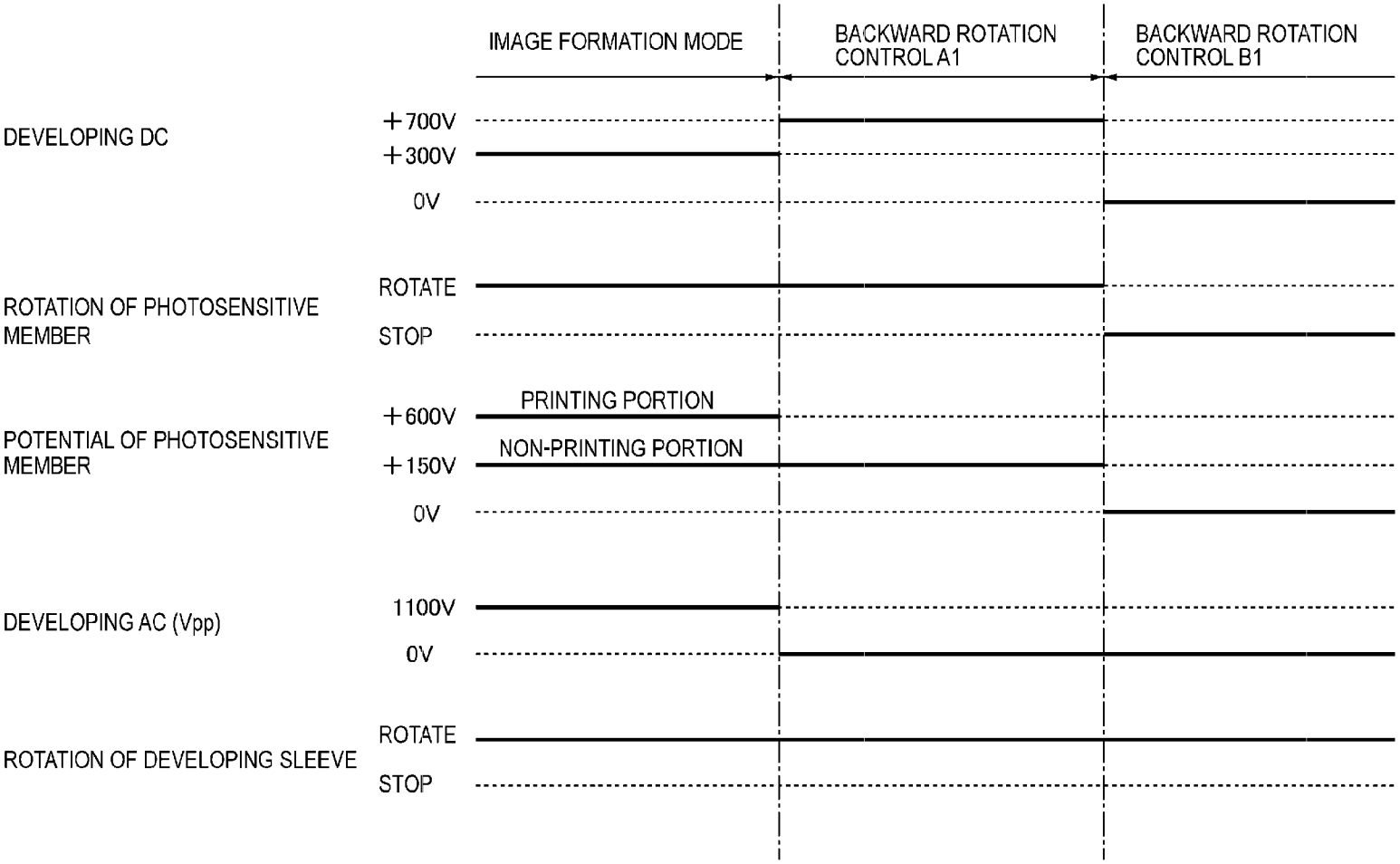
FIG. 6 is a diagram illustrating biases and driving control of the developing device according to the first embodiment.

Thus, when clusters of agglomerates are highly likely to remain accumulated in the SS portion after the end of image formation (YES in S103 of FIG. 5), first, the clusters of agglomerates having moved to the SS portion are scattered by the backward rotation control A1 as the removal control. As illustrated in FIG. 6, during the backward rotation control A1, the photosensitive member 2 is driven in a state of being separated from the transfer roller 6, and the entire surface of the photosensitive member is exposed and the potential Vl is 150 V.

Figure 8:
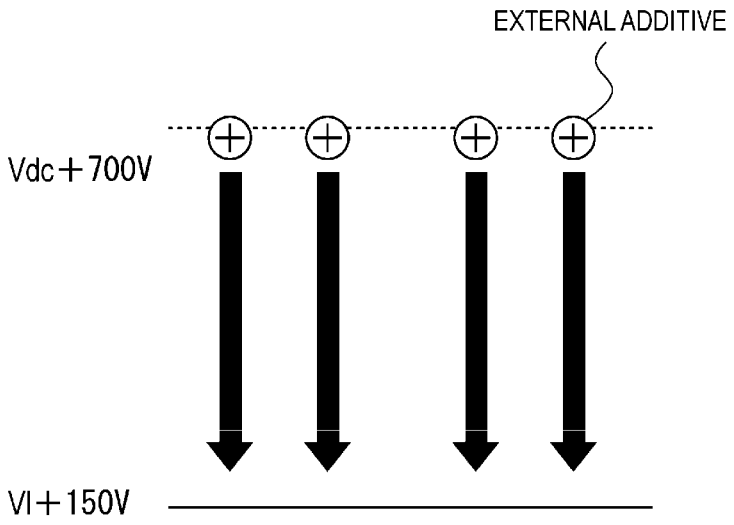
FIG. 8 is a diagram illustrating a movement of clusters of agglomerates during backward rotation control A1.

On the other hand, the developing bias Vdc is set to +700 V, and a strong bias of the opposite-polarity from that during development is applied to the developing sleeve. It is known that the external additive which is the cause of clusters of agglomerates is charged with positive polarity opposite from that of the toner. Thus, by rotating the developing sleeve in a state in which the clusters of agglomerates have moved to the SS portion as described above, the external additive which is the cause of clusters of agglomerates can be scattered from the SS portion between the developing sleeves 41*a* and 41*b* toward the photosensitive member 2 as illustrated in FIG. 8. That is, in the present embodiment, first control (backward rotation control A1) of rotating the developing sleeve can be executed in a state in which a developing bias is applied such that the force acting in the direction of moving the opposite-polarity particles from that of the normally charged toner from the developing sleeves 41*a* and 41*b* to the photosensitive member 2 is larger than that of the normal image formation. In this case (non-image formation), an AC bias is not applied to the developing bias as illustrated in FIG. 6. The clusters of agglomerates scattered toward the photosensitive member 2 are removed and collected by the cleaning device 8 because the photosensitive member 2 is rotating. In the present embodiment, the reason why an AC bias is not applied to the developing bias during the backward rotation control A1 is to decrease the proportion of the AC bias and to increase the proportion of the DC bias to thereby discharge clusters of agglomerates efficiently while preventing leakage due to application of a bias.

Further, backward rotation control B1 as removal control is performed continuously to the backward rotation control A1 as removal control. During the backward rotation control B1, the developing sleeve is rotated whereby the clusters of agglomerates which have not been scattered during the backward rotation control A1 can be crushed and forced out of the SS portion as illustrated in FIG. 9B.

As illustrated in FIG. 6, during the backward rotation control B1, the potential of the photosensitive member is 0 V and the photosensitive member is not rotated. Further, a developing bias is not applied, and the upper first developing sleeve 41*a* which is one developer bearing member (first developer bearing member) rotates at a faster circumferential velocity than the lower second developing sleeve 41*b* which is the other developer bearing member (second developer bearing member). In FIG. 9B, the circumferential velocity of the first developing sleeve 41*a* is slv1 (mm/sec) and the circumferential velocity of the second developing sleeve 41*b* is slv2 (mm/sec). Both circumferential velocities are in the relation of slv1>slv2. In the present embodiment, during normal image formation, a relation that the circumferential velocity of the first developing sleeve 41*a* is faster than the circumferential velocity of the second developing sleeve 41*b* is satisfied. Thus, in the present embodiment, the backward rotation control A1 and B1 is performed under the same velocity (driving) control as the normal image formation. However, the backward rotation control may be performed under a different driving condition from the normal image formation. For example, the velocity ratio (slv1/slv2) in the backward rotation control B1 may be increased from that of normal image formation in order to crush more clusters of agglomerates. Moreover, the velocity slv1 in the backward rotation control B1 may be increased from that of normal image formation.

Figure 9A:
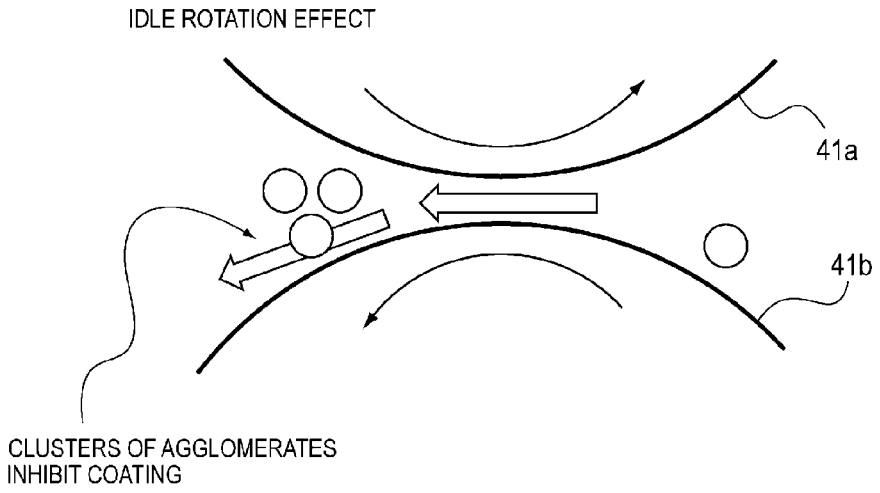
FIGS. 9A and 9B are diagrams illustrating a movement of clusters of agglomerates during backward rotation control B1.
Figure 9B:
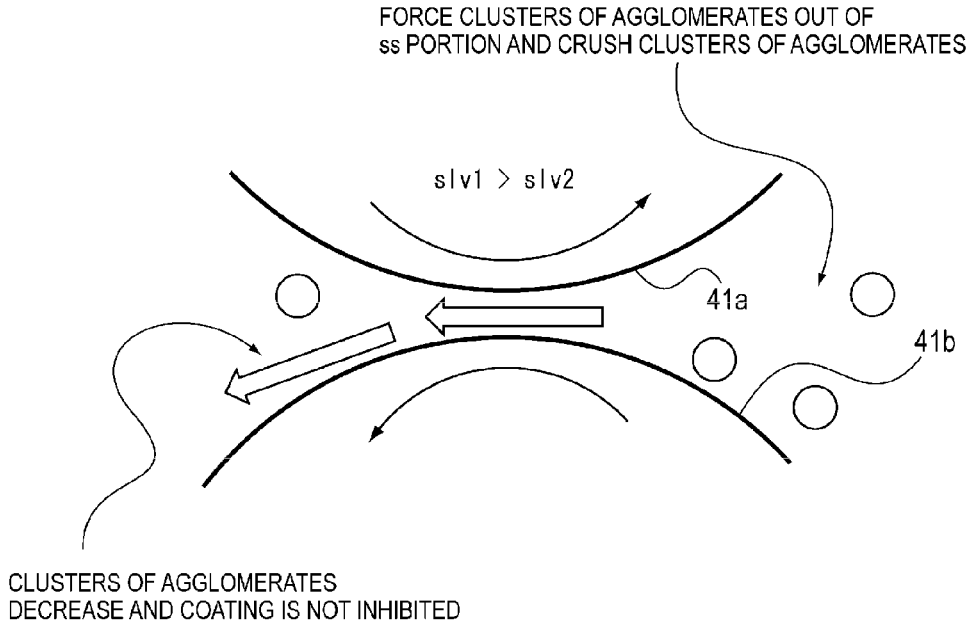

Thus, when a developing bias is not applied and the upper first developing sleeve 41*a* makes idle rotation at a faster circumferential velocity than the lower second developing sleeve 41*b*, the clusters of agglomerates having moved to the SS portion can easily enter into the space between the developing sleeves 41*a* and 41*b* as illustrated in FIG. 9A. Moreover, the clusters of agglomerates are forced out of the SS portion and enter toward the developing device 4 while being crushed between the developing sleeves 41*a* and 41*b* as illustrated in FIG. 9B. For the clusters of agglomerates to be moved efficiently, it is preferable to provide a velocity difference so that the circumferential velocity of the lower second developing sleeve 41*b* is 95% or lower than the circumferential velocity of the upper first developing sleeve 41*a*.

By performing the backward rotation control B1 continuously to the backward rotation control A1 clusters of agglomerates which have not been scattered in the backward rotation control A1 can be crushed and removed from the SS portion.

Figure 10:
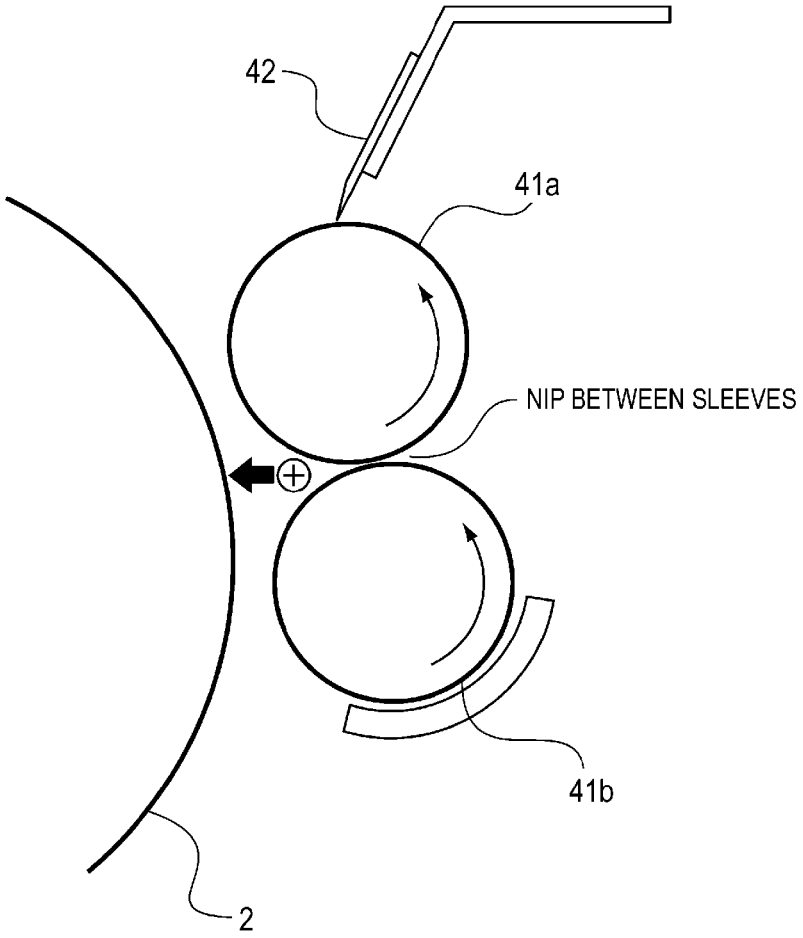
FIG. 10 is a diagram illustrating the force of an electric field applied to clusters of agglomerates during backward rotation control A1.
Figure 11:
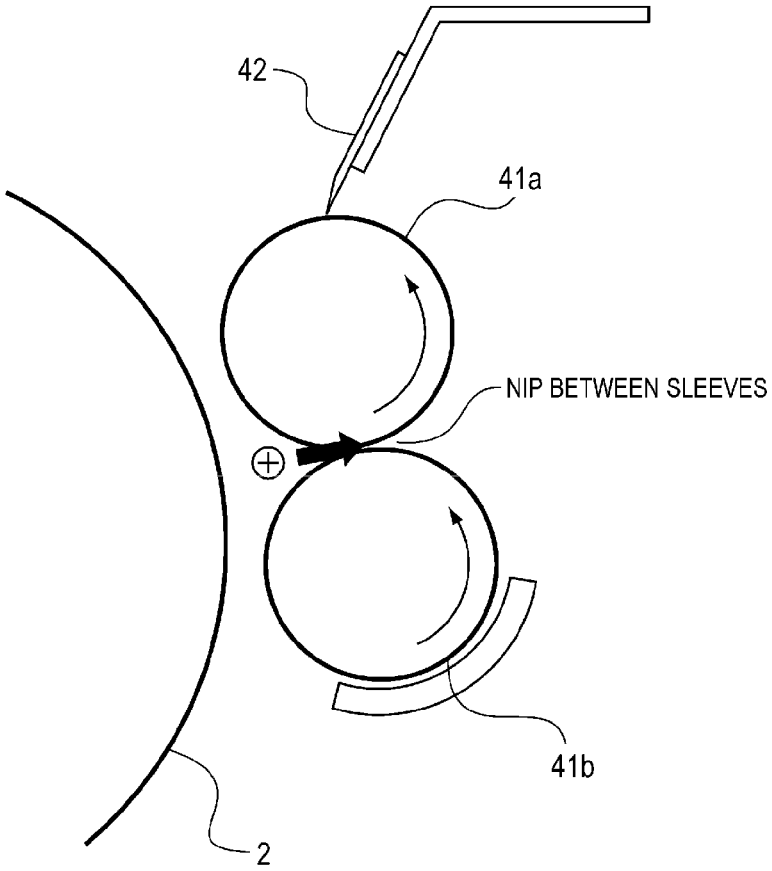
FIG. 11 is a diagram illustrating the force of an electric field applied to clusters of agglomerates during backward rotation control B2 according to a second embodiment.

During the backward rotation control A1, as illustrated in FIG. 10, a strong bias is applied to clusters of agglomerates in the direction toward the photosensitive member 2 and force is applied such that the clusters of agglomerates are moved away from the SS portion. Thus, clusters of agglomerates do not enter into the SS portion. However, during the backward rotation control B1, as illustrated in FIG. 11, since a bias is applied, clusters of agglomerates enter into the SS portion and are crushed and removed from the SS portion. Therefore, it is possible to suppress white stripes.

Figure 12:
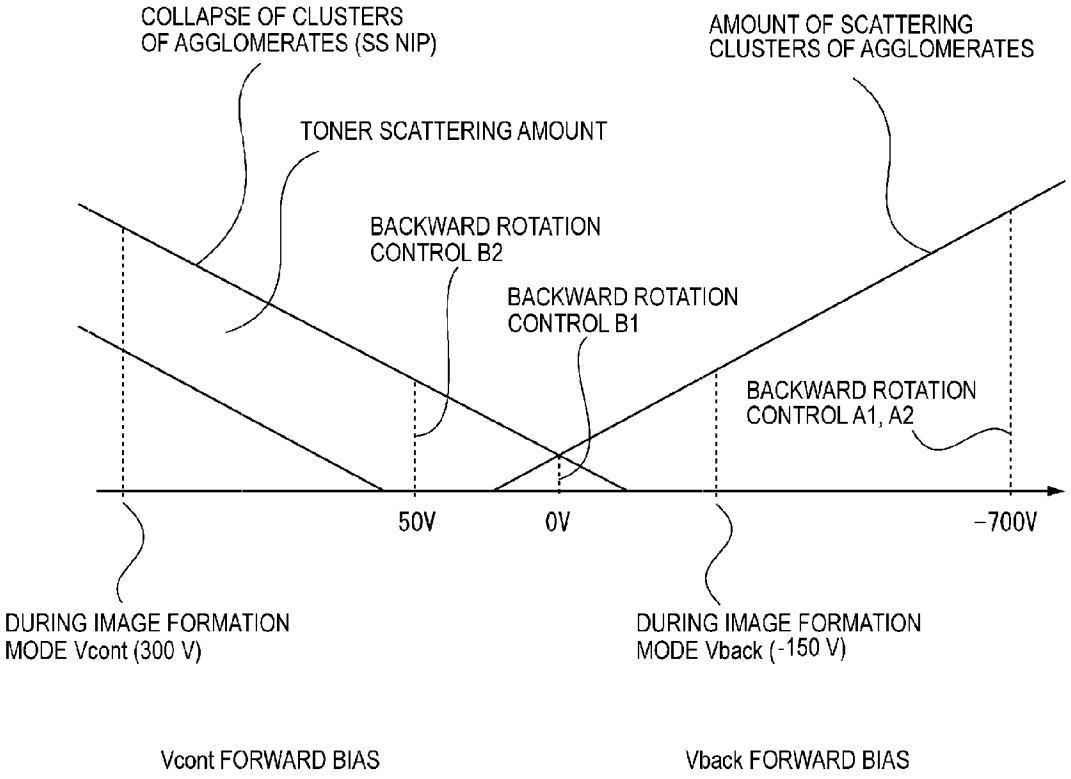
FIG. 12 is a diagram illustrating the effects of backward rotation control biases according to the first and second embodiments.

FIG. 12 illustrates the effect of removing clusters of agglomerates for respective biases applied to the developing sleeve. During the backward rotation control A1 according to the first embodiment, the potential of the developing sleeve is higher than the potential of the photosensitive member 2, and a potential difference Vback has the same polarity as the image formation mode and is larger than that of the image formation mode. Thus, during the backward rotation control A1, (although force is applied in the direction of attracting toner toward the SS portion), small clusters of agglomerates including the external additive having the opposite polarity from that of toner are scattered from the SS portion toward the photosensitive member. On the other hand, during the backward rotation control B1, the potential of the developing sleeve is lower than the potential of the photosensitive member 2 (in the present embodiment, the developing bias is OFF), and the potential difference Vback has the same polarity as the image formation mode and is smaller than that of the image formation mode. That is, in the present embodiment, a developing bias is applied or OFF so that the force acting in the direction of moving the opposite-polarity particles from that of the normally charged toner from the developing sleeves 41*a* and 41*b* toward the photosensitive member 2 is smaller than that of the normal image formation or becomes zero. In this state, second control (backward rotation control B1) of rotating one developer bearing member at a faster circumferential velocity than the other developer bearing member can be executed. Thus, during the backward rotation control B1, (although force is applied in the direction of moving toner away from the SS portion), large clusters of agglomerates including the external additive (opposite-polarity particles) having the opposite-polarity from that of the normally charged toner are attracted toward the SS portion and crushed in the SS portion.

In this manner, by performing the backward rotation control A1 (first control) and the backward rotation control B1 (second control) in combination and continuously as the removal control, it is possible to remove clusters of agglomerates present in the SS portion and to suppress white stripes.

In the present embodiment, although the backward rotation control B1 is performed continuously to the backward rotation control A1, the order of the backward rotation control A1 and the backward rotation control B1 is arbitrary. By performing the two control operations of the backward rotation control A1 and the backward rotation control B1 in combination and continuously, it is possible to remove clusters of agglomerates present in the SS portion and to suppress white stripes. More preferably, as in the present embodiment, it is desirable to perform the backward rotation control A1 earlier than the backward rotation control B1 because it is possible to enhance the effect of suppressing clusters of agglomerates. Although the reasons therefor are not certain, if the backward rotation control B1 is performed earlier, the clusters of agglomerates which have not been discharged by the backward rotation control A1 may agglomerate during the backward rotation control B1. Moreover, in the present embodiment, although the backward rotation control B1 is performed continuously to the backward rotation control A1, another control may be performed between the backward rotation control A1 and the backward rotation control B1. Both the backward rotation control A1 and the backward rotation control B1 may be performed in series during non-image formation.

[Comparative Example]

Figure 28:
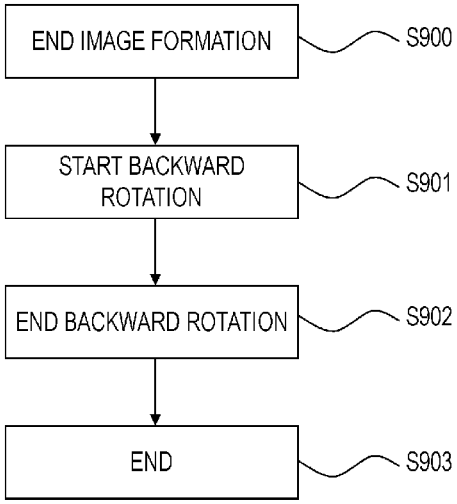
FIG. 28 PRIOR ART
FIG. 28 is a flowchart illustrating a control sequence according to a conventional example.

Next, a conventional backward rotation sequence will be described as a comparative example by referring to FIG. 28. FIG. 28 is a flowchart illustrating an image forming sequence of the image forming apparatus 100 according to a comparative example.

In the image forming apparatus of the comparative example, after image formation ends (S900), normal back rotation starts (S901) and the backward rotation ends (S902). After that, the entire image forming operation ends (S903).

The backward rotation operation of the comparative example has little effect of scattering and crushing clusters of agglomerates and does not lead to eliminating white stripes, and the bias is the same as the white background during the image formation mode.

[Test Condition]

100 sheets×500 jobs of images having an image duty of 10% were printed according to the flowcharts illustrated in FIGS. 5 and 28 and the ranks of white stripes were compared. White stripe ranks 1 to 10 were used to evaluate white stripes, and the higher the rank, the less noticeable the white stripe and the better the image quality. When a normal image is printed, a noticeable white stripe has the rank 5.

[Result and Comparison Table]

As illustrated in Table 1 below, according to the present embodiment, the operations of the backward rotation control A1 and B1 were performed when the number of passing sheets X exceeded the defined number of pages Y. Thus, it was possible to suppress white stripe ranks resulting from clusters of agglomerates and make white stripes invisible.

TABLE 1

| | WHITE STRIPE RANK |
|---|---|
| CONVENTIONAL EXAMPLE | 3 |
| FIRST EMBODIMENT | 6 |

[Second Embodiment]

The image forming apparatus according to the present embodiment has substantially the same configuration as the first embodiment, and redundant description thereof will not be provided.

Although the backward rotation control B1 was performed without applying a bias in the first embodiment, a bias of the opposite direction from backward rotation control A2 (the same as the backward rotation control A1) is applied to the developing sleeve in the backward rotation control B2 of the second embodiment so that clusters of agglomerates can easily enter into the SS nip. That is, in the present embodiment, a developing bias is applied to the developing sleeve so that force that moves the opposite-polarity particles from that of the normally charged toner toward the developing sleeves 41*a* and 41*b* acts on the particles. The developing bias may be OFF as long as force that moves the opposite-polarity particles from that of the normally charged toner toward the developing sleeves 41*a* and 41*b* is applied to the particles. In this state, second control (backward rotation control B2) of rotating one developer bearing member at a faster circumferential velocity than the other developer bearing member is performed.

FIG. 11 illustrates the force of electric field applied during the backward rotation control B2 in the image forming apparatus according to the present embodiment. Although force is applied in the direction of moving clusters of agglomerates away from the SS portion (the direction of moving the clusters of agglomerates toward the photosensitive member 2) during the backward rotation control A2 as illustrated in FIG. 10, force is applied in the direction of causing the clusters of agglomerates to enter into the SS portion during the backward rotation control B2. More specifically, during the backward rotation control B2, force is applied in the direction of attracting the external additive included in the clusters of agglomerates without scattering toner. Thus, during the backward rotation control B2 of the present embodiment, clusters of agglomerates can easily enter into the SS portion as compared to during the backward rotation control B1 of the first embodiment.

FIG. 12 illustrates the effect of removing clusters of agglomerates for respective biases applied to the developing sleeve. The backward rotation control A2 of the second embodiment has the effect of scattering small clusters of agglomerates similarly to the backward rotation control A1 of the first embodiment. The backward rotation control B2 of the second embodiment has the effect of scattering large clusters of agglomerates as compared to the backward rotation control B1 of the first embodiment.

A developing bias (0 V) is not applied during the backward rotation control B1 of the first embodiment, whereas a bias for enhancing the effect of scattering clusters of agglomerates in the SS portion is applied to the developing sleeve during the backward rotation control B2 of the second embodiment. Here, if a strong bias is applied, toner on the developing sleeve may scatter toward the photosensitive member 2, which is undesirable. Thus, a smaller bias than the image formation mode is applied during the backward rotation control B2. Specifically, in the present embodiment, a lower bias 50 V (see FIG. 12) than the bias during the image formation mode is applied during the backward rotation control B2 so that the external additive included in the clusters of agglomerates are attracted without scattering toner.

[Apparatus Configuration]

The configuration associated with driving of the image forming apparatus 100 according to the present embodiment is the same as the configuration described in the first embodiment and illustrated in FIG. 4, and redundant description thereof by referring to FIG. 4 will not be provided.

[Bias Sequence During Image Formation→Backward Rotation]

Figure 13:
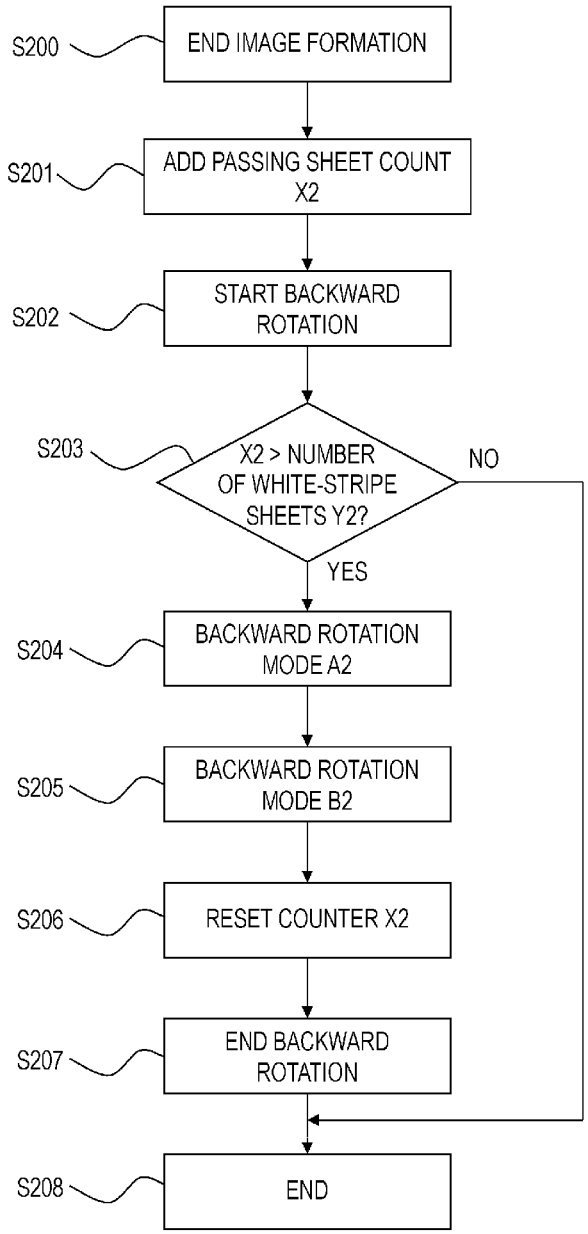
FIG. 13 is a flowchart illustrating the flow of a control operation according to the second embodiment.

FIG. 13 illustrates a control sequence used in the present embodiment. The control sequence used in the present embodiment is substantially the same as the control sequence described in the first embodiment and illustrated in FIG. 5 except that the backward rotation control B2 is different from the backward rotation control B1 of the first embodiment. Thus, only the backward rotation control B2 will be described, and redundant description of the other portions will not be provided. Steps S200 to S208 in FIG. 13 except S205 are the same as steps S100 to S108 in FIG. 5 except S105.

The backward rotation control B2 (S205) of the present embodiment involves applying a bias to the developing sleeve in the opposite direction from the backward rotation control A1 (A2) as illustrated in FIG. 12 whereas the backward rotation control B1 of the first embodiment does not apply a developing bias as described above.

[Description of Bias Control Value During Image Formation]

Next, bias control of the image forming apparatus during image formation and backward rotation control will be described by referring to FIG. 14.

In the present embodiment, a BAE method is used and, as illustrated in FIG. 7, negatively charged toner moves toward a charging potential Vd of +600 V higher than an exposure potential Vdc of +300 V on the photosensitive member 2 whereby an image is formed. On the other hand, an exposing portion is a white background portion which is not exposed and the potential Vl on the photosensitive member 2 is 150 V lower than the exposure potential Vdc of 300 V.

During an image formation mode, the AC bias 1100 V (see image formation mode of FIG. 14) is added to the developing bias. In this state, the photosensitive member 2 is driven and the latent image on the photosensitive member is developed by toner and the developed toner image is transferred to a transfer member.

When clusters of agglomerates are highly likely to remain accumulated in the SS portion after the end of image formation (YES in S203 of FIG. 13), first, the clusters of agglomerates having moved to the SS portion are scattered by the backward rotation control A2 (first control) as the removal control. During the backward rotation control A2, the photosensitive member 2 is driven in a state of being separated from the transfer roller 6, and the entire surface of the photosensitive member is exposed and the potential Vl is 150 V.

On the other hand, the developing bias Vdc is set to 700 V, and a strong bias of the opposite-polarity from that during development is applied to the developing sleeve. It is known that the external additive which is the cause of clusters of agglomerates is charged with positive polarity opposite from that of the toner. Thus, by rotating the developing sleeve in a state in which the clusters of agglomerates have moved to the SS portion as described above, the external additive which is the cause of clusters of agglomerates can be scattered toward the photosensitive member 2 as illustrated in FIG. 8. In this case (non-image formation), an AC bias is not applied to the developing bias as illustrated in FIG. 14. The clusters of agglomerates scattered toward the photosensitive member 2 are removed and collected by the cleaning device 8 because the photosensitive member 2 is rotating.

Further, backward rotation control B2 (second control) as removal control is performed continuously to the backward rotation control A2 as removal control. During the backward rotation control B2, the developing sleeve is rotated and a developing bias is applied to the clusters of agglomerates which have not been scattered during the backward rotation control A2 whereby the clusters can be crushed and forced out of the SS portion as illustrated in FIG. 9B.

Figure 14:
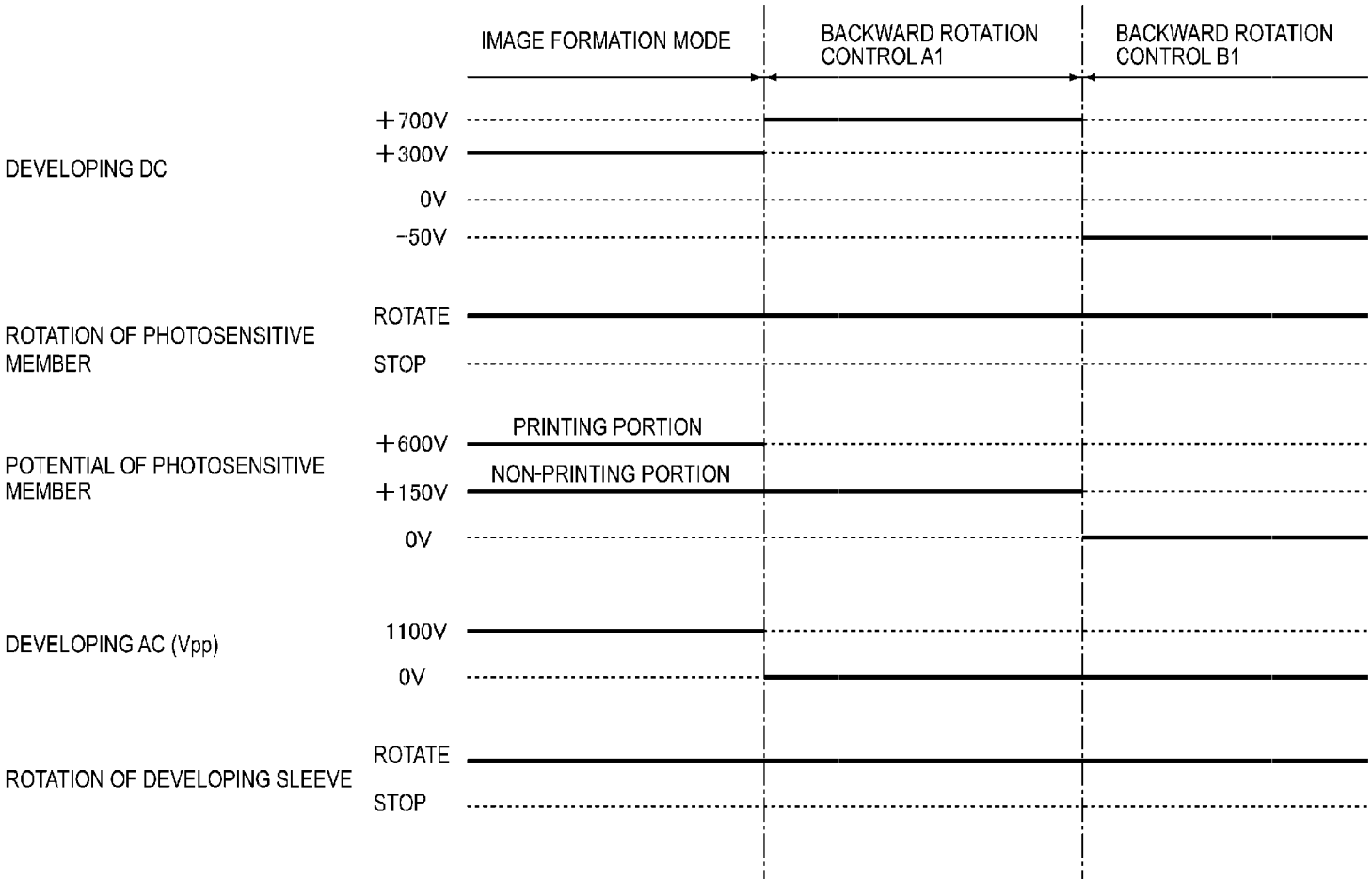
FIG. 14 is a diagram illustrating biases and driving control of a developing device according to the second embodiment.

As illustrated in FIG. 14, during the backward rotation control B2, the potential of the photosensitive member is 0 V and the photosensitive member is not rotated.

In this case, (backward rotation control B2), a developing bias of −50 V is applied in the opposite direction from that of the normal bias. With this developing bias, force is applied to the clusters of agglomerates in the direction of allowing the clusters of agglomerates to enter into the SS portion. Thus, the clusters of agglomerates can easily enter into the SS portion as compared to the backward rotation control B1 of the first embodiment and white stripes can be suppressed.

When a developing bias of the opposite direction is applied to the developing sleeve in this state to rotate the developing sleeve, the effect of crushing clusters of agglomerates illustrated in FIG. 12 can be enhanced and larger clusters of agglomerates can be forced out of the SS portion quickly.

[Result and Comparison Table]

The same investigation (test) as the first embodiment was performed to check the configuration of the second embodiment. As illustrated in Table 2 below, it was possible to make white stripes less visible than the first embodiment.

TABLE 2

| | WHITE STRIPE RANK |
|---|---|
| CONVENTIONAL EXAMPLE | 3 |
| FIRST EMBODIMENT | 6 |
| SECOND EMBODIMENT | 7 |

[Third Embodiment]

The image forming apparatus according to the present embodiment has substantially the same configuration as the second embodiment, and redundant description thereof will not be provided.

As compared to the second embodiment, the third embodiment optimizes the execution time of the two backward rotation control as the removal control according to the number of passing sheets.

The external additive which causes clusters of agglomerates clogging in the SS portion is externally added in a new developer in a certain proportion to the toner. Since the external additive has the opposite-polarity from that of the toner and force is applied to the external additive in the opposite direction from the developing direction during toner development, the external additive is not scattered toward the photosensitive member 2 and remains in the developing device.

Figure 15:
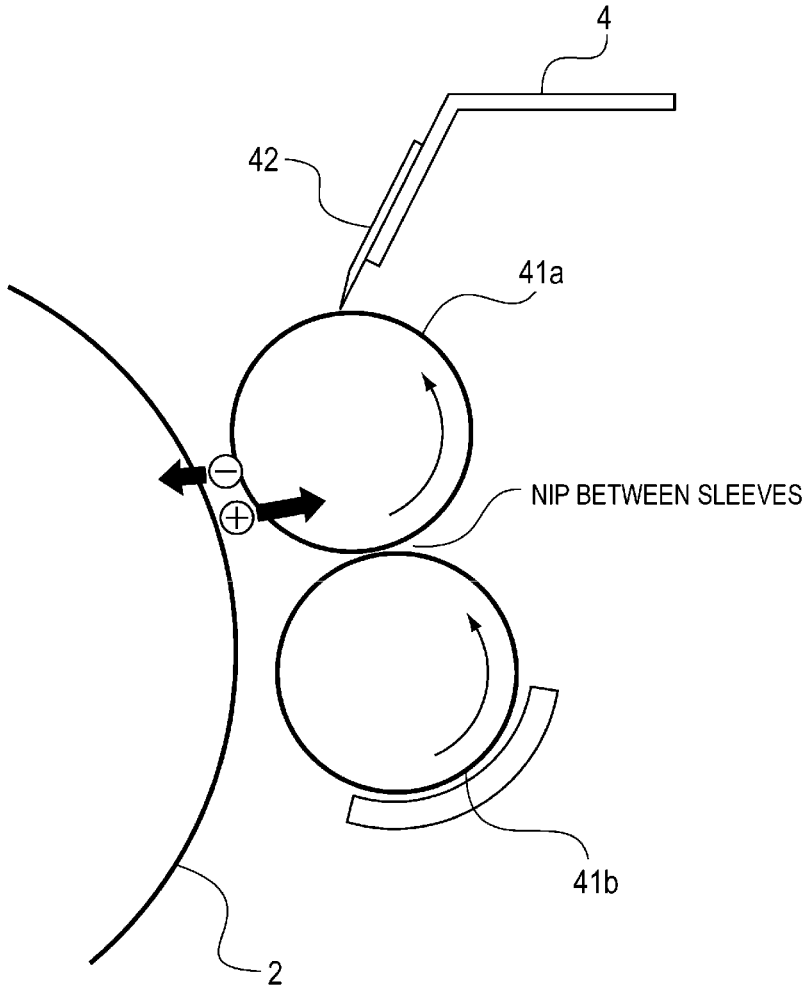
FIG. 15 is a diagram illustrating the force applied to toner and external additive during normal image formation (image formation mode).

FIG. 15 illustrates the movement of the external additive during toner development. As illustrated in FIG. 15, although the negative-polarity toner is developed by being moved toward the photosensitive member 2 by electric field, the positive-polarity external additive having the opposite-polarity from the toner returns into the developer storage member by receiving the force toward the developing device 4.

Figure 16:
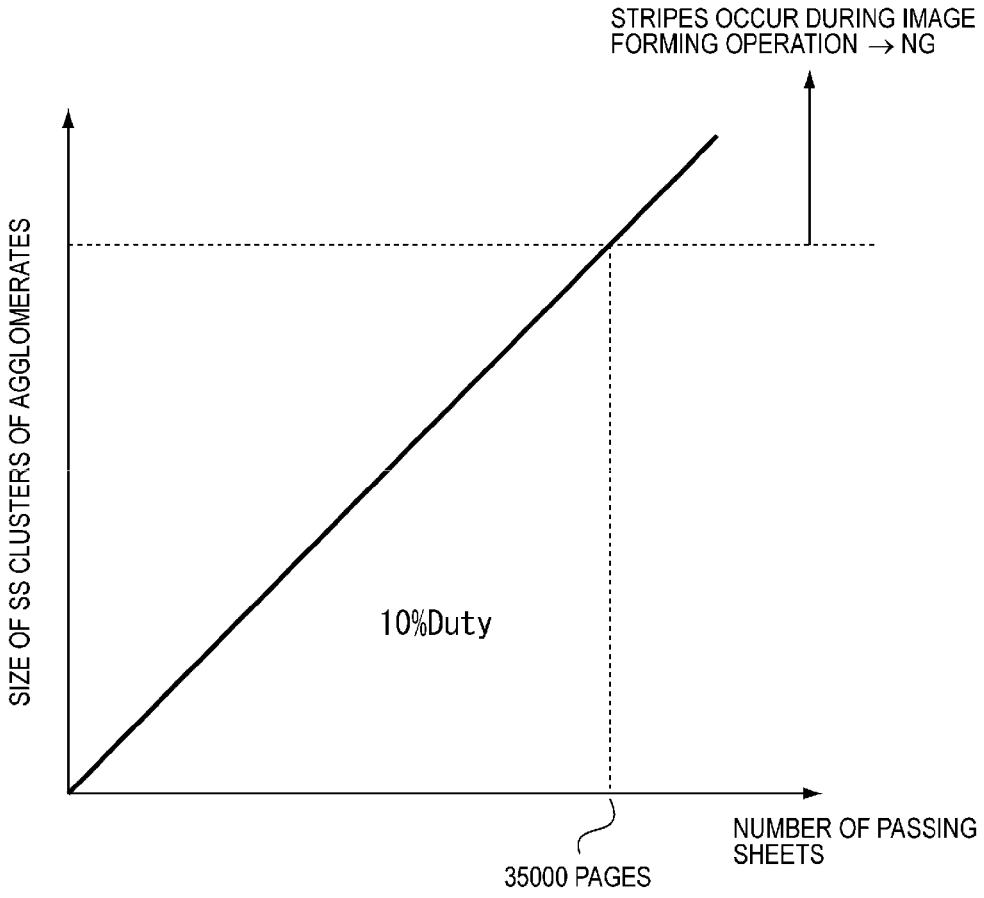
FIG. 16 is a diagram illustrating the relation between the number of passing sheets and the amount of clusters of agglomerates accumulating in a SS portion.
Figure 17:
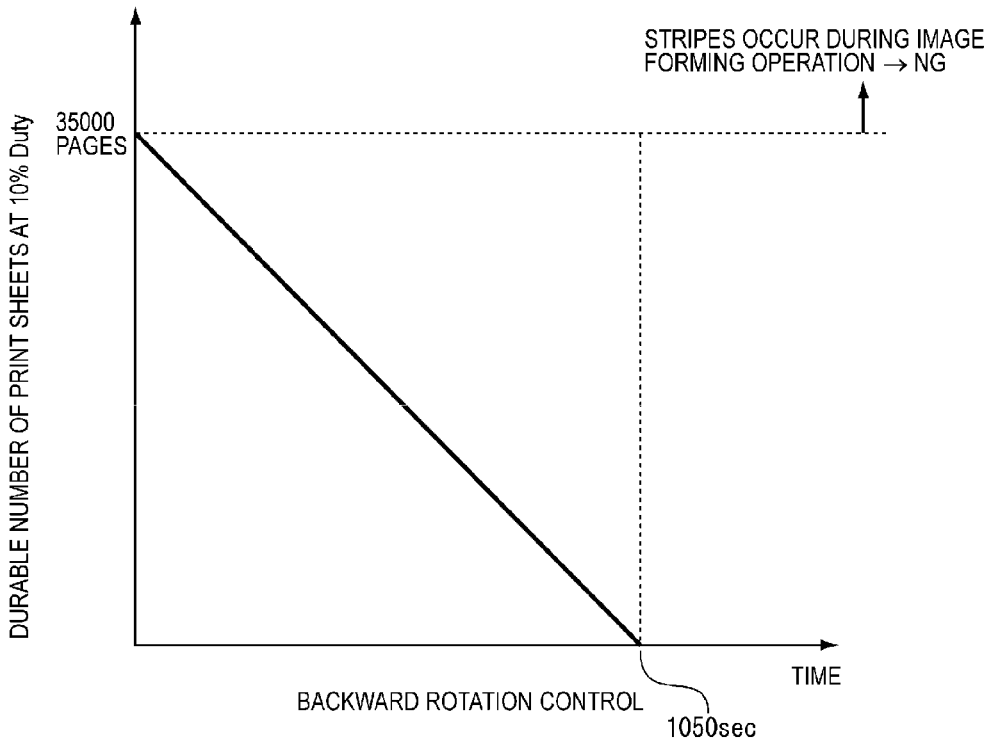
FIG. 17 is a diagram illustrating the relation between backward rotation control execution time and the decrease in the amount of clusters of agglomerates.

Thus, if the image duty is the same, the amount of clusters of agglomerates is proportion to the number of passing sheets. FIG. 16 illustrates the relation between the number of passing sheets and the amount of clusters of agglomerates accumulating in the SS portion. As illustrated in FIG. 16, it can be understood that, when approximately 35,000 pages of an image (in this example, an image having the image duty of 10%) is printed from the initial state, the size of a cluster of agglomerates increases and a noticeable white stripe appears in an image. Moreover, as illustrated in FIG. 17, 1,050 seconds of backward rotation control is required from the occurrence of a white stripe in order to completely remove clusters of agglomerates.

By adjusting the backward rotation control execution time according to the amount of clusters of agglomerates converted from the number of passing sheets by utilizing this relation, it is possible to remove and eliminate clusters of agglomerates appropriately even if the print job is very long.

[Apparatus Configuration]

The configuration associated with driving of the image forming apparatus 100 according to the present embodiment is the same as the configuration described in the first embodiment and illustrated in FIG. 4, and redundant description thereof by referring to FIG. 4 will not be provided.

[Bias Sequence During Image Formation→Backward Rotation]

Figure 18:
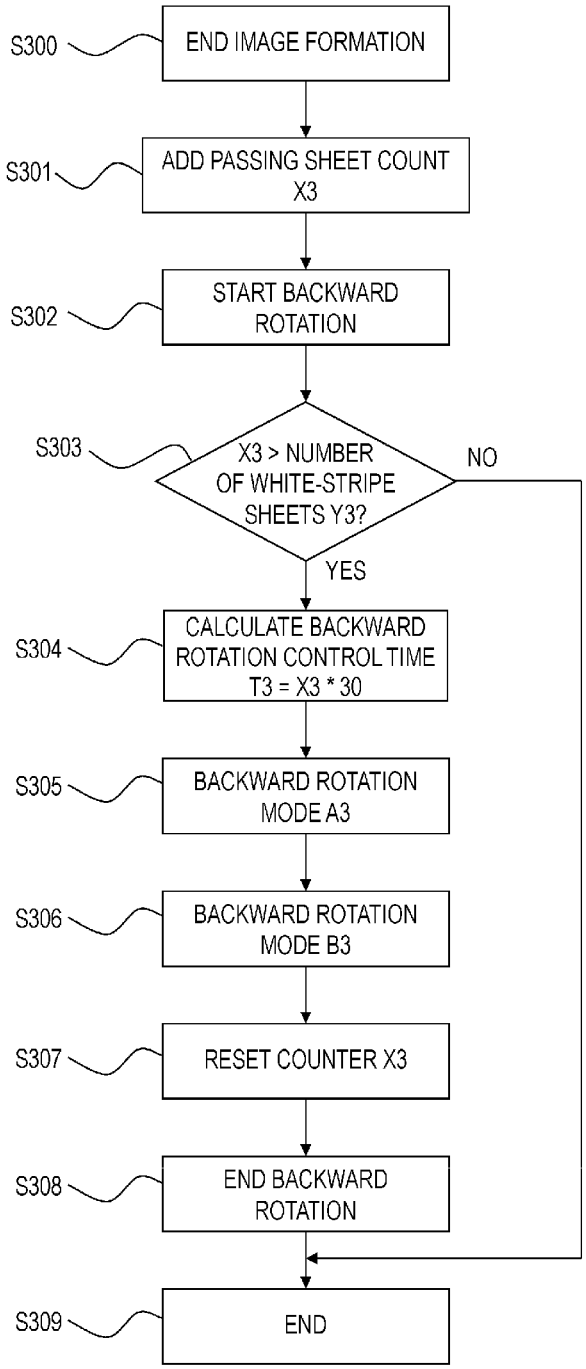
FIG. 18 is a flowchart illustrating the flow of a control operation according to a third embodiment.

FIG. 18 illustrates a control sequence used in the present embodiment. First, after image formation ends (S300), the passing sheet count X is added (S301). After that, backward rotation starts (S302) and it is determined whether the number of passing sheets X exceeds a defined number of pages Y (in the present embodiment, 2,000 pages) (S303).

When it is determined in S303 that the number of passing sheets X exceeds the defined number of pages Y, the flow proceeds to S304 and backward rotation control A3 (first control) is performed as removal control of removing clusters of agglomerates between the first and second developing sleeves 41*a* and 41*b*. Subsequently, in S305, backward rotation control B3 (second control) is performed as the removal control. In this case, the execution time T3 of the backward rotation control A3 and B3 is changed according to the passing sheet counter X3 (K pages). In the present embodiment, the execution time T3 (*sec*) is set to T3=X3×30.

Here, in the equation, 30 is a coefficient indicating the execution time per unit number of passing sheets. This coefficient is determined based on the following investigation. That is, it is known that, when 2,000 pages of sheets were printed using the apparatus described in the first embodiment and the backward rotation control A1 and B1 was performed for 60 seconds, white stripes resulting from clusters of agglomerates were eliminated. From this, the coefficient of the execution time T3 of backward rotation control per 1,000 sheets is set to 30.

After the backward rotation control A3 and B3 is executed, the passing sheet count X is reset (S306) and the backward rotation ends (S307).

On the other hand, when it is determined in S303 that the number of passing sheets X is equal to or smaller than the defined number of pages Y, S304 to S306 are not performed, and the flow proceeds to S307 to end backward rotation. After that, the entire image forming operation ends (S308).

[Description of Bias Control Value During Image Formation]

The image forming apparatus uses the same bias control as that described in the second embodiment and illustrated in FIG. 14 during the image formation (image formation mode) and the backward rotation control. Thus, detailed description thereof will not be provided.

[Result and Comparison Table]

The same comparative investigation (test) as the first and second embodiments was performed. In addition to the test performed in the first and second embodiments in which 100 sheets×500 jobs of images having an image duty of 10% were printed and the ranks of white stripes were compared, a test of printing 10,000 sheets×5 jobs of images having an image duty of 10% was performed to compare the ranks of white stripes.

As illustrated in Table 3 below, according to the configuration of the third embodiment, even when the length of a print job increased, it was possible to make white stripes less visible as compared to the configuration of the first and second embodiments.

TABLE 3

| | WHITE STRIPE RANK (100 SHEETS OF JOB) | WHITE STRIPE RANK (10000 SHEETS OF JOB) |
|---|---|---|
| CONVENTIONAL EXAMPLE | 3 | 3 |
| FIRST EMBODIMENT | 6 | 4 |
| SECOND EMBODIMENT | 7 | 5 |
| THIRD EMBODIMENT | 7 | 7 |

[Fourth Embodiment]

The image forming apparatus according to the present embodiment has substantially the same configuration as the third embodiment except for the control configuration, and redundant description thereof will not be provided.

In the present embodiment, the execution time of the two backward rotation control as the removal control is changed according to a toner consumption amount (=(image duty)×(number of passing sheets)) during previous image formation.

The external additive which causes clusters of agglomerates clogging in the SS portion is externally added in a new developer in a certain proportion to the toner. Since the external additive has the opposite-polarity from that of the toner and force is applied to the external additive in the opposite direction from the developing direction during toner development, the external additive is not scattered toward the photosensitive member 2 and remains in the developing container.

Figure 19:
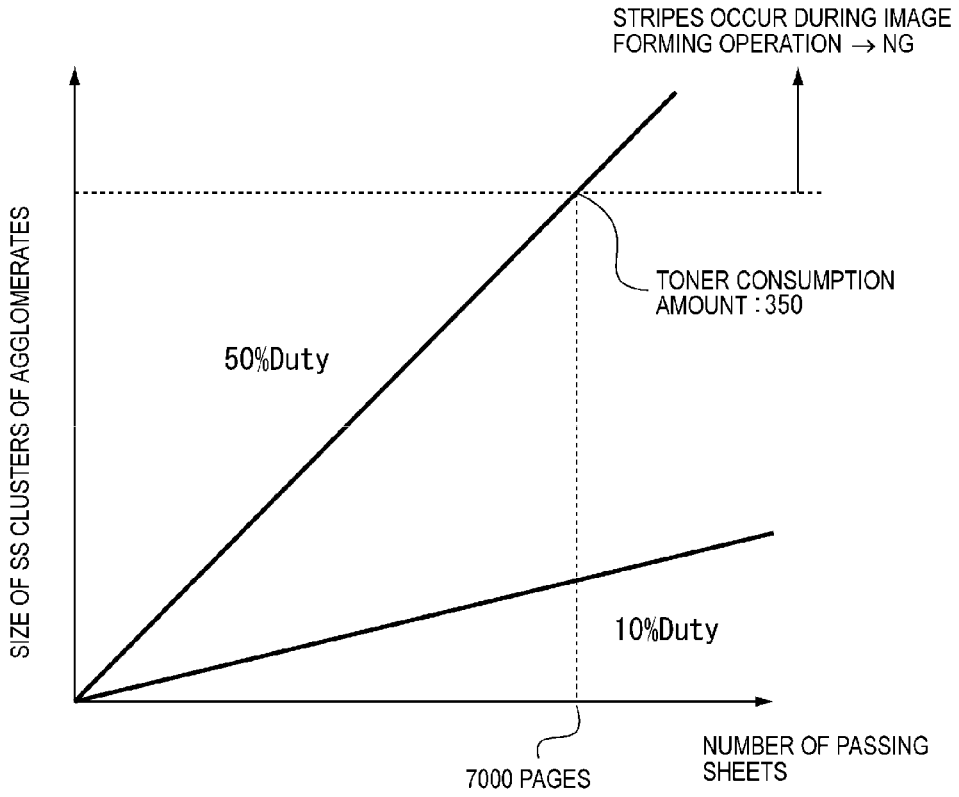
FIG. 19 is a diagram illustrating the relation between the number of passing sheets for each image duty of an output image and the amount of clusters of agglomerates accumulating in the SS portion.

Thus, even if the number of passing sheets is the same, the higher the image duty, the larger the toner consumption amount and the more cluster of agglomerates is formed. FIG. 19 illustrates such a relation. As illustrated in FIG. 19, in an image having the image duty of 50%, a white stripe occurs in a number of pages which is ⅕ times that of the image having the image duty of 10%. Thus, by changing the execution time T4 of backward rotation control according to the toner consumption amount, it is possible to prevent white stripes even when a large number of pages of high-duty image are printed.

[Apparatus Configuration]

The configuration associated with driving of the image forming apparatus 100 according to the present embodiment is the same as the configuration described in the first embodiment and illustrated in FIG. 4, and redundant description thereof by referring to FIG. 4 will not be provided.

[Bias Sequence During Image Formation→Backward Rotation]

Figure 20:
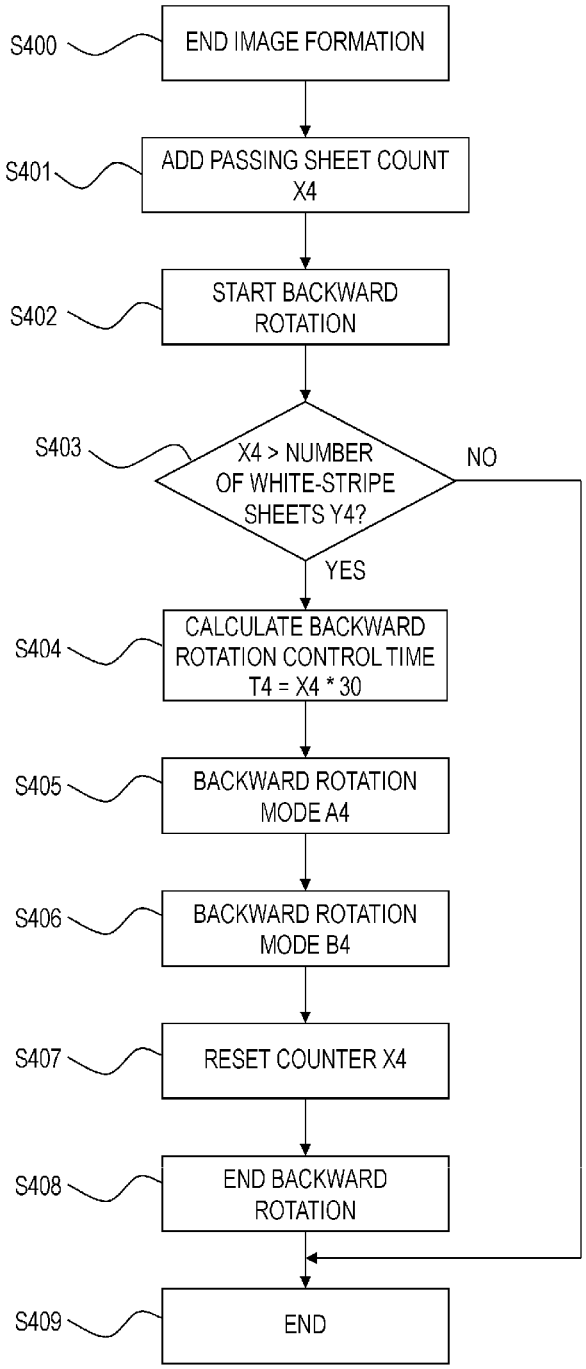
FIG. 20 is a flowchart illustrating the flow of a control operation according to a fourth embodiment.

FIG. 20 illustrates a control sequence used in the present embodiment. In the present embodiment, the execution time T4 of backward rotation control is changed according to a toner consumption amount X4 during the previous image formation. Here, the toner consumption amount X4 is (pixel number ratio (%) of image data when a sheet passes)×(number of passing sheets (K pages)). For example, when 4,000 pages of 50% duty images were printed, X=50×4=200.

First, after image formation ends (S400), a toner consumption amount is integrated from an image ratio of a digitally processed image and the number of passing sheets and a toner consumption amount count X4 is added (S401). After that, backward rotation starts (S402), and it is determined whether the number of passing sheets X4 exceeds a defined number of pages Y4 (in the present embodiment, the toner consumption amount is set to 200) (S403).

When the number of passing sheets X4 exceeds the defined number of pages Y4, the flow proceeds to S404 and backward rotation control A4 (first control) is performed as removal control of removing clusters of agglomerates between the first and second developing sleeves 41*a* and 41*b*. Subsequently, in S405, backward rotation control B4 (second control) is performed as the removal control.

In this case, the execution time T4 of the backward rotation control is changed according to the count X4. In the present embodiment, the execution time T4 (*sec*) is set to T4=X4×30.

Here, in the equation, 30 is a coefficient. This coefficient is determined based on the following investigation. That is, it is known that, when 2,000 pages of sheets of 10% duty images were printed using the apparatus described in the first embodiment and the backward rotation control A1 and B1 was performed for 60 seconds, white stripes resulting from clusters of agglomerates were eliminated. From this, the coefficient of the execution time T4 of backward rotation control per 1,000 sheets is set to 30.

After the backward rotation control A4 and B4 is executed, the passing sheet count X4 is reset (S406) and the backward rotation ends (S407).

On the other hand, when it is determined in S403 that the number of passing sheets X4 is equal to or smaller than the defined number of pages Y4, S404 to S406 are not performed, and the flow proceeds to S407 to end backward rotation. After that, the entire image forming operation ends (S408).

[Description of Bias Control Value During Image Formation]

The image forming apparatus uses the same bias control as that described in the second embodiment and illustrated in FIG. 14 during the image formation (image formation mode) and the backward rotation control similarly to the third embodiment. Thus, detailed description thereof will not be provided.

[Result and Comparison Table]

A test of printing 100 sheets×500 jobs of images having an image duty of 10% and 100 sheets×500 jobs of images having an image duty of 50% was performed to compare the ranks of white stripes and the productivity.

As illustrated in Table 4 below, according to the present embodiment, it was possible to suppress the occurrence of white stripes in high duty images and to maintain the productivity in low duty images.

TABLE 4

| | WHITE STRIPE RANK (10%) | WHITE STRIPE RANK (50%) |
|---|---|---|
| CONVENTIONAL EXAMPLE | 3 | 1 |
| FIRST EMBODIMENT | 6 | 2 |
| SECOND EMBODIMENT | 7 | 3 |
| THIRD EMBODIMENT | 7 | 3 |
| FOURTH EMBODIMENT | 7 | 7 |

[Fifth Embodiment]

The image forming apparatus according to the present embodiment has substantially the same configuration as the first embodiment except for the control configuration, and redundant description thereof will not be provided.

The durable number of print sheets until white stripes resulting from clusters of agglomerates occur changes depending on the durable number of print sheets of the developing device 4. The amount of the external additive accumulating near the developing sleeves 41*a* and 41*b* in the developing device 4 is small in the initial stage of use and increases gradually with the toner consumption amount whereby large clusters of agglomerates are formed.

Thus, in the fifth embodiment, the length of the execution time of the two backward rotation control A5 and B5 for crushing and scattering clusters of agglomerates and the proportion (ratio) of the two backward rotation control are changed according to the degree of accumulation of clusters of agglomerates.

Since clusters of agglomerates are not scattered by application of a bias if too many clusters of agglomerates accumulate, the proportion of the backward rotation control B5 for crushing clusters of agglomerates is increased as compared to the backward rotation control A5 for scattering the clusters of agglomerates.

The proportions of backward rotation control are the same when 2,000 pages of 10% duty images (corresponding to a consumption amount of 20 pages) are printed in the first embodiment. However, when a larger amount of clusters of agglomerates accumulate, the proportion of the backward rotation control B5 for crushing clusters of agglomerates is increased as compared to the backward rotation control A5 for scattering clusters of agglomerates.

Figure 21:
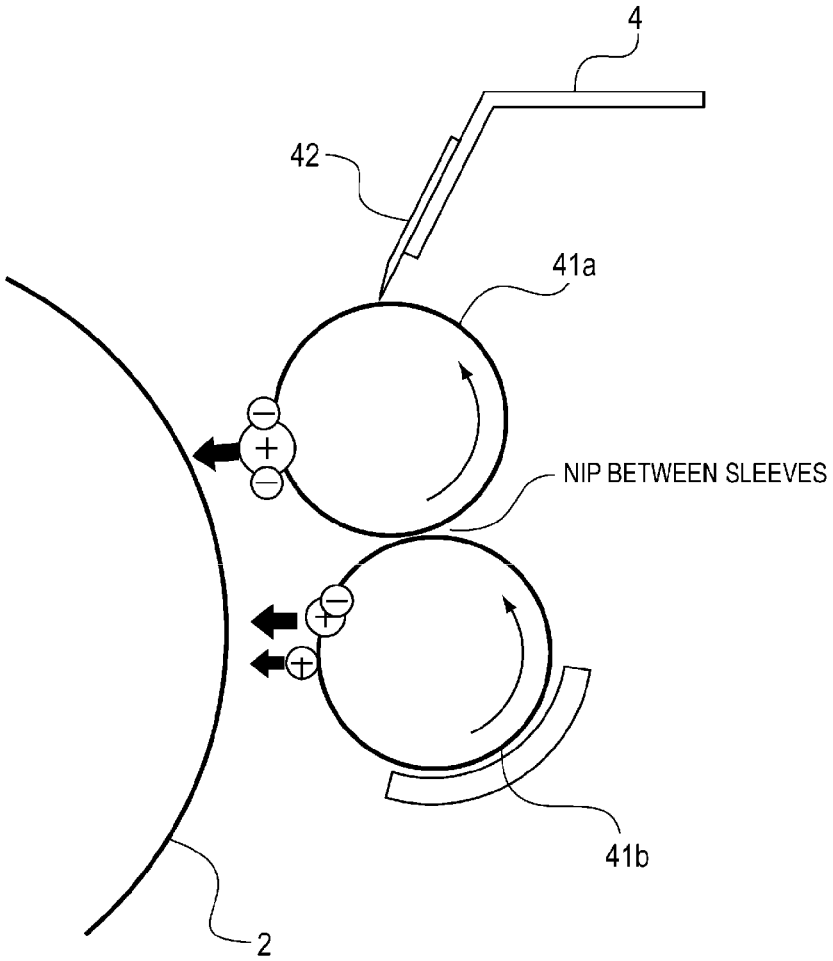
FIG. 21 is a diagram schematically illustrating the force applied to a cluster of agglomerates for each size of the cluster of agglomerates.

FIG. 21 schematically illustrates the force applied to clusters of agglomerates for each size of the clusters of agglomerates. First, when the clusters of agglomerates are small, the force of electric field is applied to the external additive and the clusters of agglomerates move toward the photosensitive member. However, when clusters of agglomerates accumulate to a certain extent or more, the developer itself is attracted, the charge does not increase with the size of the clusters of agglomerates but only the mass increases. Due to this, since the mass is larger than the force of electric field even if a bias is applied, the developer is not scattered toward the photosensitive member 2. Thus, the clusters of agglomerates that have not be scattered need to be crushed in the SS portion.

Figure 22:
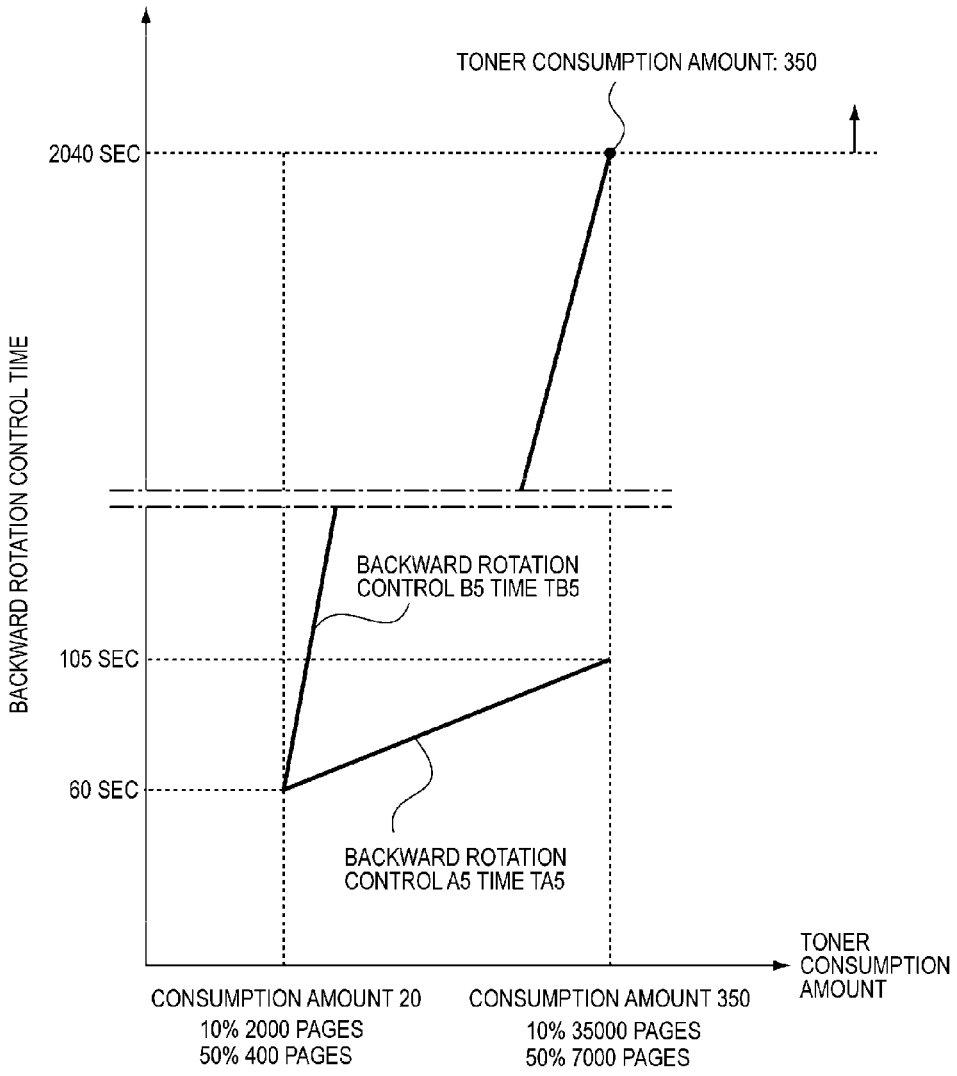
FIG. 22 is a diagram illustrating the relation between a toner consumption amount and each backward rotation control time according to a fifth embodiment.

FIG. 22 illustrates the relation between the toner consumption amount (the amount of clusters of agglomerates) and the execution time of the backward rotation control A5 and B5. In a normal case (the consumption amount of 20 pages), the execution time of the backward rotation control A5 and B5 is 60 seconds. However, when 7,000 pages of 50% duty images were printed continuously (the consumption amount is 350 pages), for example, so that the amount of clusters of agglomerates is too large, the execution time TA5 of the backward rotation control A5 is 105 seconds, whereas the execution time TB5 of the backward rotation control B5 is 2,040 seconds. The total execution time of the backward rotation control A5 and B5 is the same as that of the fourth embodiment.

[Apparatus Configuration]

The configuration associated with driving of the image forming apparatus 100 according to the present embodiment is the same as the configuration described in the first embodiment and illustrated in FIG. 4, and redundant description thereof by referring to FIG. 4 will not be provided.

[Bias Sequence During Image Formation→Backward Rotation]

Figure 23:
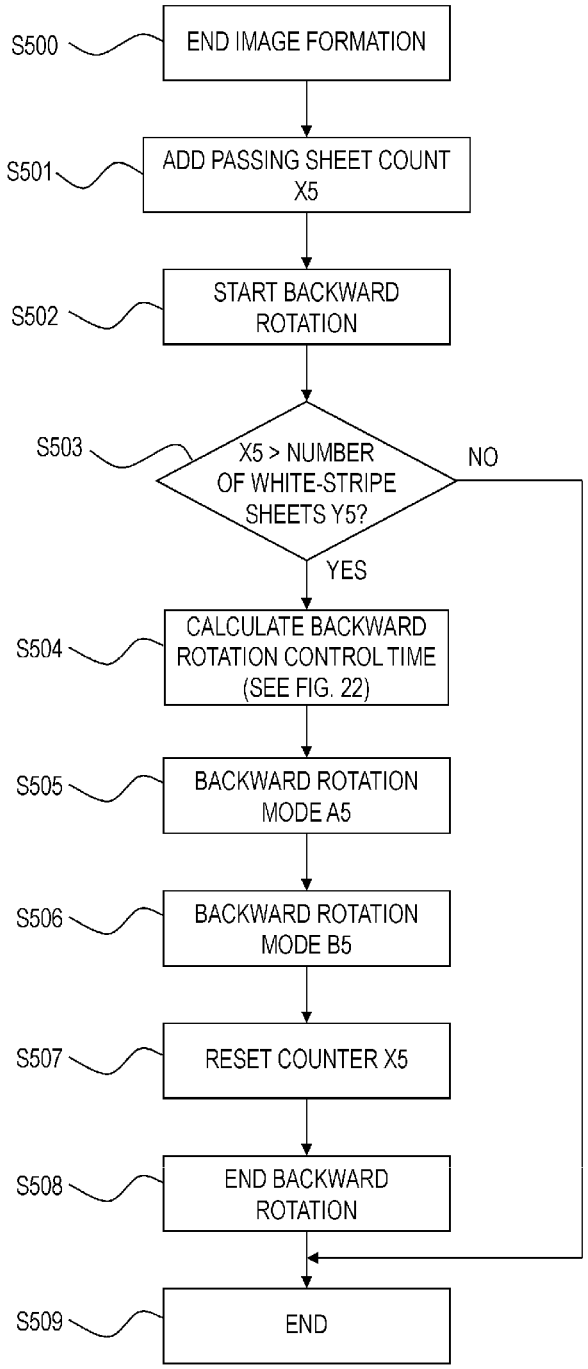
FIG. 23 is a flowchart illustrating the flow of a control operation according to the fifth embodiment.

FIG. 23 illustrates a control sequence used in the present embodiment. In the present embodiment, the execution time T4 of backward rotation control A5 and B5 is changed according to a toner consumption amount X5 during the previous image formation. Here, the toner consumption amount X5 is (pixel number ratio (%) of image data when a sheet passes)×(number of passing sheets (K pages)). For example, when 4,000 pages of 50% duty images were printed, X5=50×4=200.

First, after image formation ends (S500), a toner consumption amount is integrated from an image ratio of a digitally processed image and the number of passing sheets and a toner consumption amount count X5 is added (S501). After that, backward rotation starts (S502), and it is determined whether the number of passing sheets X5 exceeds a defined number of pages Y5 (in the present embodiment, the toner consumption amount is set to 200) (S503).

When the number of passing sheets X5 exceeds the defined number of pages Y5, the flow proceeds to S504 and backward rotation control A5 (first control) is performed as removal control of removing clusters of agglomerates between the first and second developing sleeves 41*a* and 41*b*. Subsequently, in 5505, backward rotation control B5 (second control) is performed as the removal control.

In the present embodiment, when the number of passing sheets X5 exceeds the defined number of pages Y5, the execution times TA5 and TB5 of the backward rotation control A5 and B5 are changed according to the toner consumption amount X5 added using the relation between the execution times TA5 and TB5 of the backward rotation control A5 and B5 and the toner consumption amount illustrated in FIG. 22. For example, as illustrated in FIG. 22, when 7,000 pages of 50% duty images were printed continuously, the execution time TA5 of the backward rotation control A5 is 105 seconds and the execution time TB5 of the backward rotation control B5 is 2,040 seconds. The total execution time of the backward rotation control A5 and B5 is the same as that of the fourth embodiment.

After the backward rotation control A5 and B5 is executed, the passing sheet count X5 is reset (S506) and the backward rotation ends (S507).

On the other hand, when it is determined in S503 that the number of passing sheets X5 is equal to or smaller than the defined number of pages Y5, S504 to S506 are not performed, and the flow proceeds to S507 to end backward rotation. After that, the entire image forming operation ends (S508).

[Description of Bias Control Value During Image Formation]

The image forming apparatus uses the same bias control as that described in the second embodiment and illustrated in FIG. 14 during the image formation (image formation mode) and the backward rotation control similarly to the third embodiment. Thus, detailed description thereof will not be provided.

A test of printing 5,000 sheets×10 jobs of images having an image duty of 50% was performed using the above configuration to compare the ranks of white stripes and the productivity.

As illustrated in Table 5 below, according to the present embodiment, it was possible to suppress the occurrence of white stripes even when high duty images were printed continuously.

TABLE 5

| | STRIPE LEVEL |
|---|---|
| CONVENTIONAL EXAMPLE | 1 |
| FIRST EMBODIMENT | 1 |
| SECOND EMBODIMENT | 1 |
| THIRD EMBODIMENT | 3 |
| FOURTH EMBODIMENT | 4 |
| FIFTH EMBODIMENT | 7 |

[Sixth Embodiment]

Figure 24:
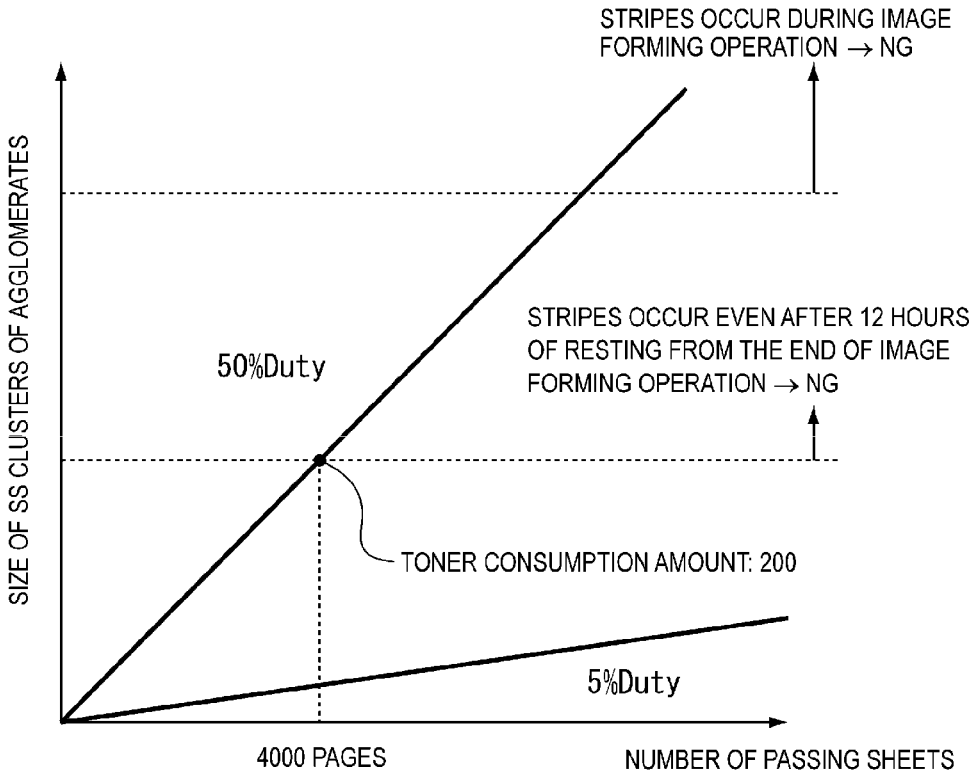
FIG. 24 is a diagram illustrating the relation between the number of passing sheets and the size of the cluster of agglomerates accumulating in the SS portion.

The image forming apparatus according to the present embodiment has substantially the same configuration as the first embodiment, only the different control configurations will be described, and redundant description thereof will not be provided. FIG. 24 illustrates a graph illustrating the relation between the number of passing sheets and the size of clusters of agglomerates accumulating in the SS portion. In FIG. 24, the horizontal axis represents the number of passing sheets, and the vertical axis represents the size of clusters of agglomerates accumulating in the SS portion.

In the image forming apparatus of the present embodiment, even when a white stripe does not appear on an image during an image forming operation, a white stripe may appear after the elapse of a predetermined period after the end of the image formation (for example, when an image forming operation is performed again after the image forming operation was performed yesterday. In general, the charging amount of toner decreases when an image forming operation is not performed for a predetermined period. When the charging amount of toner decreases, the ability to develop a latent image on the photosensitive member 2 also decreases. Thus, when an image forming operation is performed continuously, even if a coating defect resulting from clusters of agglomerates is present in the second developing sleeve 41*b*, if the width of the coating defect is small, the latent image in the coating defect can be developed by the toner on both sides of the coating defect.

However, in a state in which the charging amount of toner during another image forming operation after a predetermined period of resting has decreased, even if the size of clusters of agglomerates is the same as before resting, the latent image in the coating defect cannot be developed by the toner on both sides of the coating defect and a white stripe appears on an image. Moreover, the size of clusters of agglomerates accumulating in the SS portion changes according to an image duty and the number of passing sheets. Specifically, as illustrated in FIG. 24, it is known that, the higher the image duty and the larger the number of passing sheets, the larger the clusters of agglomerates accumulating in the SS portion. This is because, when image formation is performed a new external additive is supplied to the vicinity of the developing sleeve together with toner.

Therefore, in the present embodiment, it is determined whether or not to perform control corresponding to the removal control according to the first embodiment prior to image formation according to the toner consumption amount during the previous image formation and the resting time elapsed until the start of the next image formation from the end of the previous image formation. That is, it is determined whether or not to perform removal control of performing forward rotation control B performed prior to image formation as the second control corresponding to the backward rotation control B1 after forward rotation control A performed prior to image formation is performed as the first control corresponding to the backward rotation control A1. Here, the toner consumption amount in the present embodiment is (pixel number ratio (%) of image data when a sheet passes)×(number of passing sheets (K pages)). For example, when 4,000 pages of 50% Duty images were printed, X5=50×4=200. The present invention is not limited to this, and the toner consumption amount may be calculated, for example, by measuring the supply time of the toner supply device 24 in FIG. 3, the number of rotations and the rotation time of a supply screw (not illustrated) to calculate the supply amount.

In the present embodiment, the resting time elapsed from the end of the image formation indicates the time elapsed from the stopping of the developing sleeve after the end of the image forming operation, but the resting time elapsed from the end of image formation is not limited to this. For example, the resting time may be determined arbitrarily according to the operation of the image forming apparatus by starting counting of the resting time from the stopping time of the photosensitive member.

In the image forming apparatus of the present embodiment, when 4K pages of 50% duty images are printed continuously, a white stripe resulting from clusters of agglomerates in the SS portion is not noticeable on the image immediately after the printing (toner consumption amount: 200 pages). However, when an image forming operation was performed to print 50% duty images after 12 hours of resting from the end of the image formation, a white stripe resulting from clusters of agglomerates was noticed. The white stripe can be eliminated by performing forward rotation control A and B for a predetermined period (in this example, 10 minute) prior to the image formation. By performing the forward rotation control A and B, it is possible to make the charging amount of toner the same as that during image formation and to crush clusters of agglomerates and move the same toward the developing device to thereby eliminate the occurrence of white stripes as described in the first embodiment.

Figure 25:
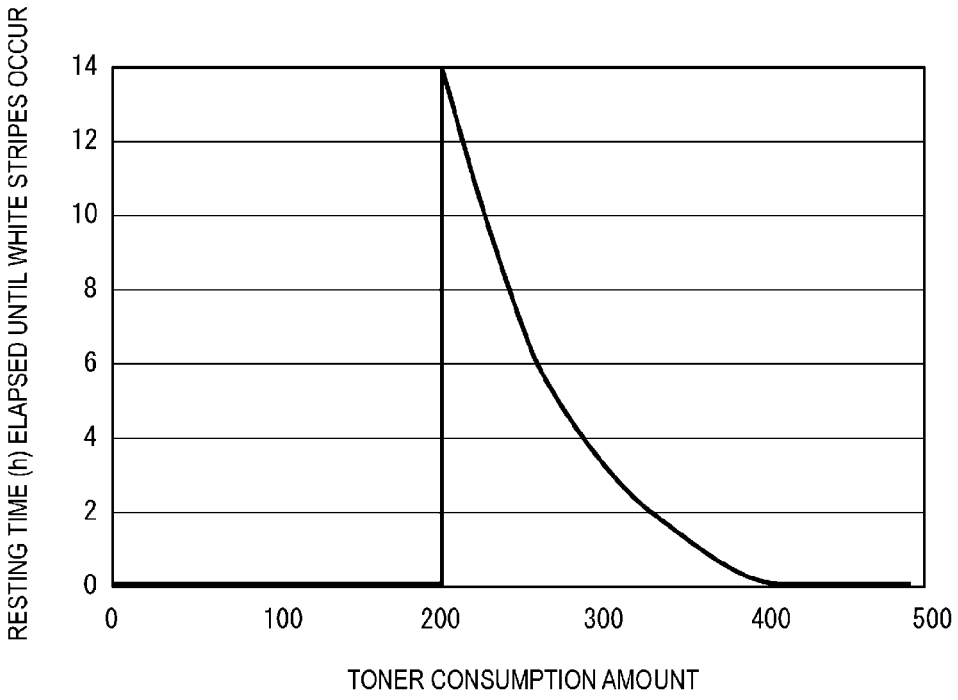
FIG. 25 is a diagram illustrating the relation between a toner consumption amount and the resting time elapsed until a white stripe occurs.
Figure 26:
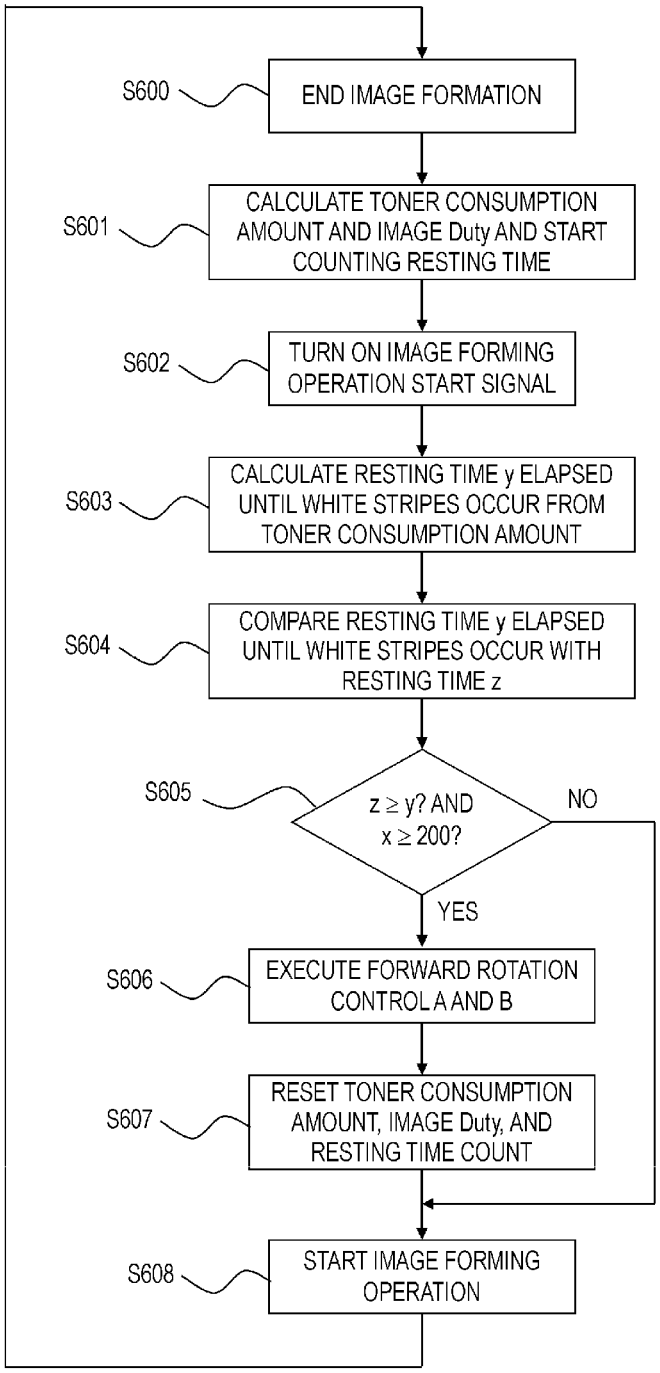
FIG. 26 is a flowchart illustrating the flow of a control operation according to a sixth embodiment.

Moreover, the relation between the resting time and the occurrence of white stripes is substantially proportional to the toner consumption amount, and in the present embodiment, has such a relation as illustrated in the graph of FIG. 25. In FIG. 25, the horizontal axis represents the toner consumption amount and the vertical axis represents the resting time elapsed until a white stripe appears after printing was performed with the respective toner consumption amounts. Thus, the control sequence illustrated in FIG. 26 was determined according to the graph of FIG. 25. FIG. 26 illustrates the flowchart illustrating the forward rotation control according to the present embodiment.

As illustrated in FIG. 26, after an image forming operation ends (S600), the CPU 105 of FIG. 4 calculates the toner consumption amount and the number of passing sheets measured until the end of the present image forming operation from the time at which the forward rotation control according to the present embodiment was performed and stores the calculation result in the RAM 107. At the same time, counting of the resting time z from the stopping of the developing sleeves 41*a* and 41*b* starts (S601).

The resting time z may be counted, for example, by storing the ending time of image formation temporarily in the RAM 107 of FIG. 4 and comparing the stored time with the time at which a signal for starting the next image forming operation is ON to thereby count the resting time. However, the method of counting the resting time z elapsed until the start of image formation from the end of image formation is not limited to this, and an optional method may be used as long as the resting time can be measured.

When an image forming operation start signal is turned ON (S602), the resting time y elapsed until the occurrence of white stripes is calculated from the toner consumption amount x calculated in advance (S603). In the present embodiment, when the resting time and the toner consumption amount elapsed until a white stripe occurs are defined as y and x, respectively, the resting time y is calculated using an equation ($y=-0.06x+24$). This equation is determined based on the following investigation. That is, when 2,000 pages of 10% duty images were printed using the apparatus described in the third embodiment and the apparatus was put into a resting state immediately after the backward rotation control A and B, a white stripe started appearing after 24 hours of resting. Moreover, when 2,000 pages of 10% duty images were printed and the apparatus was put into a resting state without performing backward rotation control, a white stripe started appearing after 12 hours of resting. From the above, the coefficient of the execution time of the forward rotation control per 1,000 pages is set to 0.06 and the y-intercept is set to 24.

Subsequently, the resting time y elapsed until the occurrence of white stripes is compared with the resting time z elapsed until the start of the next image forming operation from the stopping of the developing sleeve (S604). Here, it is determined whether the resting times satisfy $z \geq y$ and the toner consumption amount satisfies $x \geq 200$ (S605). If the counted resting time z is equal to or larger than the resting time y elapsed until the occurrence of white stripes ($z \geq y$), and the toner consumption amount x is equal to or smaller than a predetermined amount (in this example, $x \geq 200$), the forward rotation control A and B is executed for a predetermined period prior to the image forming operation (S606). In this example, the forward rotation control A is performed for 10 minutes for the developing sleeves 41*a* and 41*b*, and after that, the forward rotation control B (idle rotation) is performed for 10 minutes. After that, the counts of the toner consumption amount x, the image duty, and the resting time x are reset (S607), and the image forming operation starts (S608). In S605, when the resting time z is smaller than y or the toner consumption amount x is smaller than 200, the forward rotation control A and B is not executed and the image forming operation starts (S608).

In the image forming apparatus of the present embodiment, when the toner consumption amount x was smaller than 200, even if the resting time z was increased, white stripes resulting from clusters of agglomerates did not appear. Thus, when $z \geq y$ and $x \geq 200$ in S605, the forward rotation control A and B was performed. That is, when $z<y$ or $x<200$ in S605, the forward rotation control A and B was not performed. Moreover, as illustrated in FIG. 25, when the toner consumption amount x exceeds 400, white stripes appear during an image forming operation. In this case, the removal control corresponding to the backward rotation control of the first to fifth embodiments is performed. Thus, white stripes will not appear.

As described above, according to the present embodiment, by performing the forward rotation control A and B according to the toner consumption amount and the resting time elapsed from the end of image formation, it is possible to prevent a white stripe image resulting from clusters of agglomerates occurring after a long period of resting. Moreover, since additional control is not performed prior to the image forming operation for users who prints low duty images, it is possible to shorten the first copy time.

[Seventh Embodiment]

The image forming apparatus according to the present embodiment has substantially the same configuration as the first embodiment, only the different control configurations will be described, and redundant description thereof will not be provided.

Figure 27A:
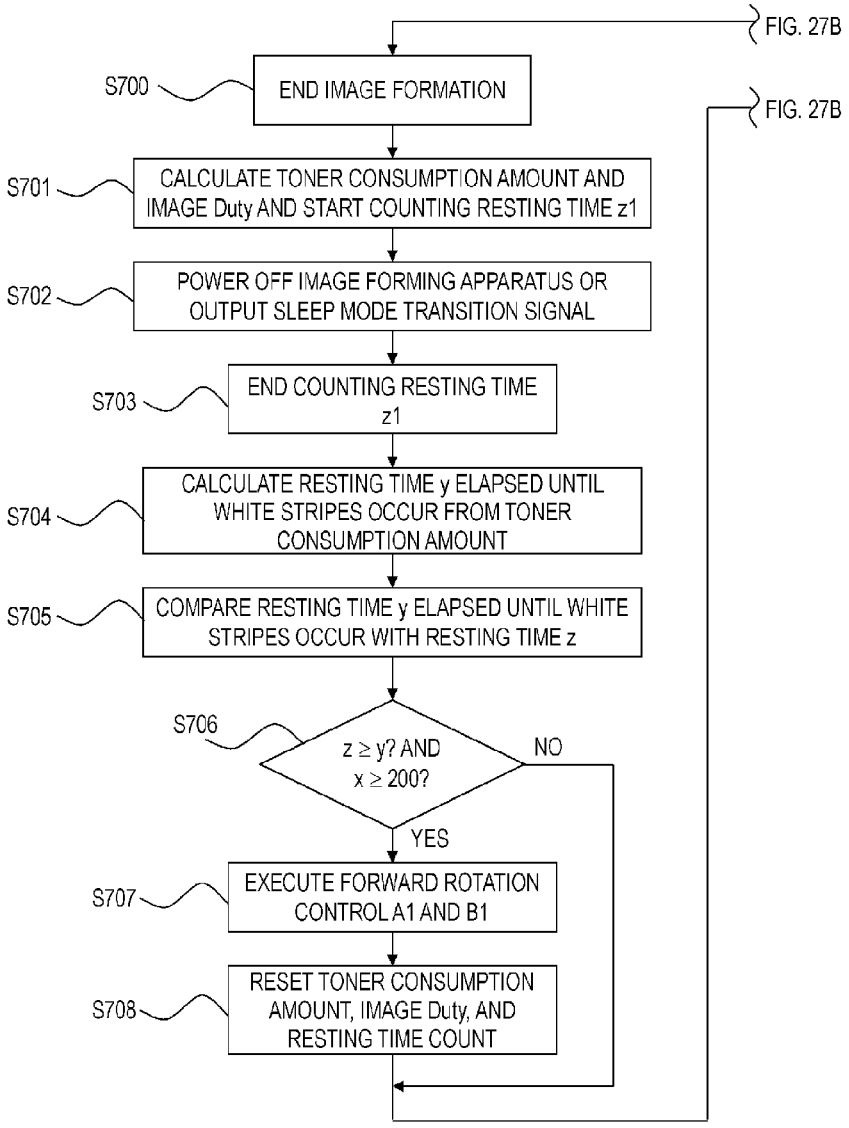
FIGS. 27A and 27B are a flowchart illustrating the flow of a control operation according to a seventh embodiment.
Figure 27B:
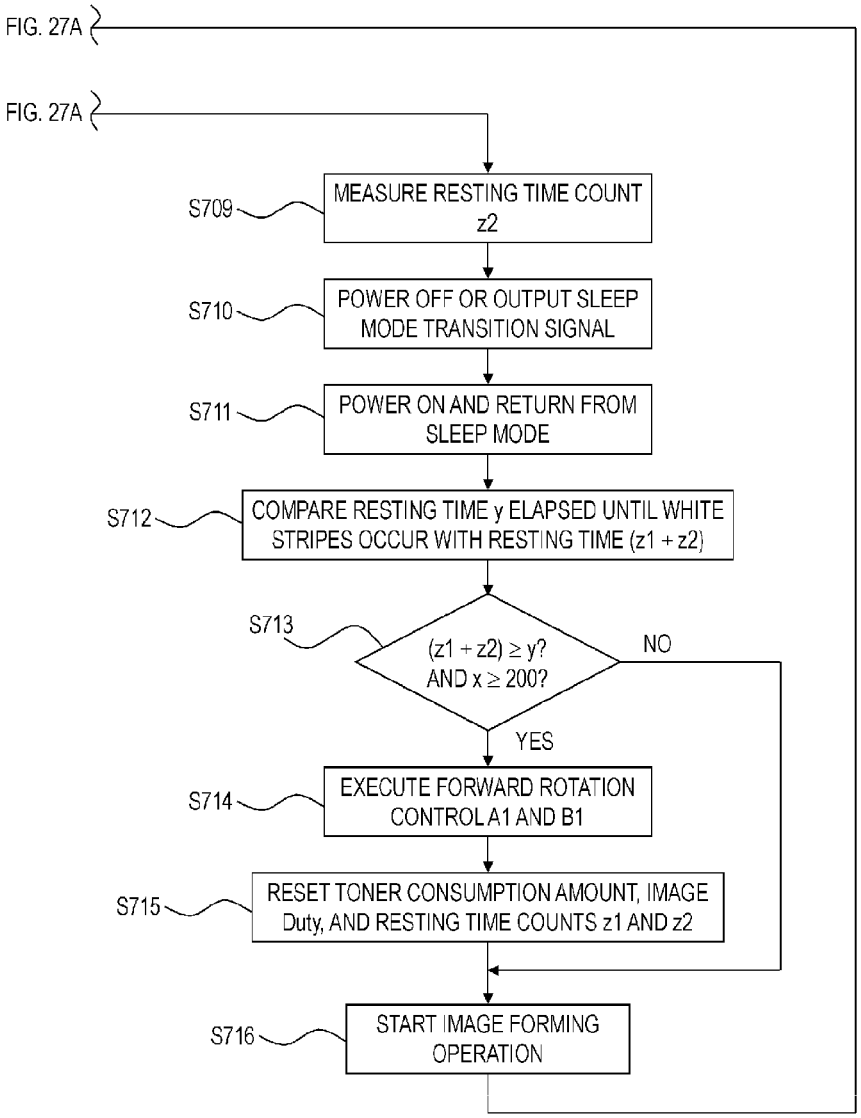

In the present embodiment, the removal control according to the sixth embodiment is performed when an image forming apparatus is powered off or enters a sleep mode and when the image forming apparatus is powered on or wakes up from the sleep mode. FIGS. 27A and 27B illustrate the flowchart of forward rotation control according to the present embodiment.

As illustrated in FIGS. 27A and 27B, after an image forming operation ends (S700), the CPU 105 of FIG. 4 calculates the toner consumption amount and the number of passing sheets measured until the end of the present image forming operation from the time at which the forward rotation control according to the present embodiment was performed and stores the calculation result in the RAM 107. At the same time, counting of the resting time z1 from the stopping of the developing sleeves 41*a* and 41*b* starts (S701). Subsequently, when the image forming apparatus is powered off by a user or enters a sleep mode (S702), counting of the resting time z1 ends (S703). Subsequently, the resting time y elapsed until the occurrence of white stripes is calculated from the toner consumption amount x calculated in advance (S704). The resting time y is calculated according to the same equation as the equation of calculating the resting time y in the sixth embodiment.

Subsequently, the resting time y elapsed until the occurrence of white stripes is compared with the resting time z1 (S705), and it is determined whether $z1 \geq y$ and $x \geq 200$ (S706). When $z1 \geq y$ and $x \geq 200$, the removal control corresponding to the backward rotation control A1 and B1 described in the first embodiment is executed for a predetermined period (in this example, 10 minutes) prior to the image forming operation (S707). That is, removal control of performing both the forward rotation control A1 performed prior to image formation as the first control corresponding to the backward rotation control A1 and the forward rotation control B1 performed prior to image formation as the second control corresponding to the backward rotation control B1 in series is executed.

Subsequently, the counts of the toner consumption amount, the image duty, and the resting time z1 are reset (S708) and information is stored in the RAM 107 of FIG. 4. After that, counting of a new resting time z2 starts (S709), and the image forming apparatus is powered off or enters a sleep mode (S710).

In S705, when the resting time z1 is smaller than the resting time y or the toner consumption amount x is smaller than a predetermined amount (200 pages), information is stored in the RAM 107 of FIG. 4 without executing removal control and resetting the counts of the toner consumption amount, image duty, and the resting time z1. After that, the resting time z2 elapsed from the time when the image forming apparatus is powered off or enters another sleep mode is counted (S709), and the image forming apparatus is powered off or enters the sleep mode (S710). The resting time elapsed from the power-off of the image forming apparatus according to the present embodiment is measured based on the time elapsed from the time when a hardware power-off switch is pressed. Moreover, the resting time elapsed from the entrance of a sleep mode is measured based on the time elapsed from the time when the controller 101 of FIG. 4 receives a sleep start signal. However, the measurement of both resting times is not limited to this, and an optional time may be set.

After the image forming apparatus is powered on or returns from the sleep mode (S711), similarly to the sixth embodiment, the resting time y elapsed until the occurrence of white stripes is compared with the resting time (z1+z2) (S712) and it is determined whether (z1+z2)≥y and x≥200 (S713). When (z1+z2)≥y and x≥200, control corresponding to the backward rotation control A1 and B1 described in the first embodiment is executed for a predetermined period (in this example 10 minutes each) prior to the image forming operation (S714). That is, removal control of performing both the forward rotation control A1 performed prior to image formation as the first control corresponding to the backward rotation control A1 and the forward rotation control B1 performed prior to image formation as the second control corresponding to the backward rotation control B1 in series is executed. After that, the counts of the toner consumption amount, the image duty, and the resting times z1 and z2 are reset (S715) and the image forming operation starts (S716).

In S713, when the resting time (z1+z2) is smaller than the resting time y or the toner consumption amount x is smaller than the predetermined amount (200 pages), the image forming operation starts without executing the control corresponding to the backward rotation control A1 and B1 described in the first embodiment prior to the image forming operation (S716). In the present embodiment, although the resting time y elapsed until the occurrence of white stripes is used for determination of the resting time z1, the present invention is not limited to this. For example, the resting time may be decreased to y/2 to lower the threshold for performing removal control. In this way, it is possible to shorten the idle rotation time during the forward rotation control further.

As described above, according to the present embodiment, by determining whether or not to perform removal control when the image forming apparatus is powered off or enters a sleep mode, it is possible to eliminate or shorten the forward rotation time when the image forming operation restarts. By doing so, it is possible to prevent a white stripe image resulting from clusters of agglomerates occurring after a long period of resting while reducing the user's waiting time.

In the present embodiment, although the removal control is performed during the backward rotation, the power-off period, or the forward rotation, the present invention is not limited to this. For example, an image forming operation may be suspended during continuous image formation according to a toner consumption amount or the number of printed pages and removal control may be performed in the suspended period.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-168103, filed Aug. 21, 2014, which is hereby incorporated by reference herein in its entirety.

What is claimed is:

1. An image forming apparatus comprising:

an image bearing member disposed rotatably and configured to bear a latent image;

a first developer bearing member disposed rotatably and bearing developer on its surface to develop the latent image formed on the image bearing member;

a second developer bearing member disposed rotatably in a same direction as the first developer bearing member and disposed at a downstream side of the first developer bearing member in a rotary direction of the image bearing member to develop the latent image developed by the first developer bearing member;

a power supply configured to apply a developing bias to the first developer bearing member and the second developer bearing member; and a controller configured to execute a control mode including both a first mode and a second mode to drive the first developer bearing member and the second developer bearing member during a non-image forming period, wherein the controller is configured to control a drive of the first developer bearing member and the second developer bearing member so that the first developer bearing member and the second developer bearing member are driven in the first mode and configured to control the developing bias and a potential of the image bearing member in the first mode so that a sign of a value of a DC component of the developing bias in the first mode minus a potential of the image bearing member in the first mode and a sign of a value of the DC component of the developing bias in an image forming period minus the potential of the image bearing member at a non-image forming area in the image forming period are the same, and so that a first potential difference between the DC component of the developing bias in the first mode and the potential of the image bearing member in the first mode is larger than a second potential difference between the DC component of the developing bias in the image forming period and the potential of the image bearing member at a non-image forming area in the image forming period, wherein the controller is configured to control a drive of the first developer bearing member and the second developer bearing member in the second mode so that the first developer bearing member rotates at a circumferential velocity faster than a circumferential velocity of the second developer bearing member, and the controller is configured to control a potential difference between the DC component of the developing bias in the second mode and a potential of the image bearing member in the second mode so as to be zero.

2. The image forming apparatus according to claim 1, wherein the controller executes the control mode when a number of passing sheets exceeds a predetermined number and after an image forming job is finished.

3. The image forming apparatus according to claim 1, wherein the power supply is configured to apply AC bias to the first developer bearing member and the second developer bearing member during the image forming period, and the controller stops applying an AC bias to the first developer bearing member and the second developer bearing member in the first mode.

4. The image forming apparatus according to claim 1, wherein in a case that a toner consumption amount is a second amount larger than a first amount, the controller sets an executing time of the control mode longer than in a case that the toner consumption amount is the first amount.

5. The image forming apparatus according to claim 1, wherein the controller changes a ratio of executing time between the first mode and the second mode according to a number of passing sheets.

6. The image forming apparatus according to claim 1, wherein the controller executes the first mode faster than the second mode in series, when the control mode is executed.

7. The image forming apparatus according to claim 1, wherein the controller is configured to control the DC component of the developing bias in the second mode so as to be zero.

8. An image forming apparatus comprising:

an image bearing member disposed rotatably and configured to bear a latent image;

a first developer bearing member disposed rotatably and bearing developer on its surface to develop the latent image formed on the image bearing member;

a second developer bearing member disposed rotatably in a same direction as the first developer bearing member and disposed at a downstream side of the first developer bearing member in a rotary direction of the image bearing member to develop the latent image developed by the first developer bearing member;

a power supply configured to apply a developing bias to the first developer bearing member and the second developer bearing member; and a controller configured to execute a control mode including both a first mode and a second mode to drive the first developer bearing member and the second developer bearing member during a non-image forming period, wherein the controller is configured to control a drive of the first developer bearing member and the second developer bearing member so that the first developer bearing member and the second developer bearing member are driven in the first mode, and the controller is configured to control the developing bias and a potential of the image bearing member in the first mode so that a sign of a value of a DC component of the developing bias in the first mode minus a potential of the image bearing member in the first mode and a sign of a value of the DC component of the developing bias in an image forming period minus the potential of the image bearing member at a non-image forming area in the image forming period are the same, and so that a first potential difference between the DC component of the developing bias in the first mode and the potential of the image bearing member in the first mode is larger than a second potential difference between the DC component of the developing bias in the image forming period and the potential at the non-image forming area of the image bearing member in the image forming period, wherein the controller is configured to control a drive of the first developer bearing member and the second developer bearing member in the second mode so that the first developer bearing member rotates at a circumferential velocity faster than a circumferential velocity of the second developer bearing member, and the controller is configured to control the developing bias and the potential of the image bearing member in the second mode so that a sign of a value of the DC component of the developing bias in the second mode minus the potential of the image bearing member in the second mode and a sign of a value of the DC component of the developing bias in the image forming period minus the potential of the image bearing member at a non-image forming area in the image forming period are the same, and so that a first potential difference between the DC component of the developing bias applied in the second mode and the potential of the image bearing member in the second mode is smaller than a second potential difference between the DC component of the developing bias applied in the image forming period and the potential of the image bearing member at a non-image forming area in the image forming period.

9. The image forming apparatus according to claim 8, wherein the controller is configured to control the DC component of the developing bias in the second mode so as to be zero.

10. The image forming apparatus according to claim 8, wherein the controller is configured to control the first potential difference so as to be zero.

11. An image forming apparatus comprising:

an image bearing member disposed rotatably and configured to bear a latent image;

a first developer bearing member disposed rotatably and bearing developer on its surface to develop the latent image formed on the image bearing member;

a second developer bearing member disposed rotatably in a same direction as the first developer bearing member and disposed at the downstream side of the first developer bearing member in a rotary direction of the image bearing member to develop the latent image developed by the first developer bearing member;

a power supply configured to apply a developing bias to the first developer bearing member and the second developer bearing member; and a controller configured to execute a control mode including both a first mode and a second mode to drive the first developer bearing member and the second developer bearing member during a non-image forming period, wherein the controller is configured to control a drive of the first developer bearing member and the second developer bearing member so that the first developer bearing member and the second developer bearing member are driven in the first mode, and the controller is configured to control the developing bias and a potential of the image bearing member in the first mode so that a sign of a value of a DC component of the developing bias in the first mode minus the potential of the image bearing member in the first mode and a sign of a value of the DC component of the developing bias in an image forming period minus the potential of the image bearing member at a non-image forming area in the image forming period are the same, and so that a first potential difference between the developing bias in the first mode and the potential of the image bearing member in the first mode is larger than a second potential difference between the developing bias in the image forming period and the potential of the image bearing member at the non-image forming area in the image forming period, wherein the controller is configured to control a drive of the first developer bearing member and the second developer bearing member in the second mode so that the first developer bearing member rotates at a circumferential velocity faster than a circumferential velocity of the second developer bearing member, and the controller is configured to control the developing bias and the potential of the image bearing member in the second mode so that a sign of a value of the DC component of the developing bias in the second mode minus the potential of the image bearing member in the second mode and a sign of a value of the DC component of the developing bias in the image forming period minus the potential of the image bearing member at a non-image forming area in the image forming period are different, and so that a first potential difference between the DC component of the developing bias applied in the second mode and the potential of the image bearing member in the second mode is smaller than a second potential difference between the DC component of the developing bias applied in the image forming period and the potential of the image bearing member at a non-image forming area in the image forming period.

12. The image forming apparatus according to claim 11, wherein the controller is configured to control the DC component of the developing bias in the second mode so as to be zero.

13. The image forming apparatus according to claim 11, wherein the controller is configured to control the first potential difference so as to be zero.

14. An image forming apparatus comprising:

an image bearing member disposed rotatably and configured to bear a latent image;

a first developer bearing member disposed rotatably and bearing developer on its surface to develop the latent image formed on the image bearing member;

a second developer bearing member disposed rotatably in a same direction as the first developer bearing member and disposed at a downstream side of the first developer bearing member in a rotary direction of the image bearing member to develop the latent image developed by the first developer bearing member;

a power supply configured to apply a developing bias to the first developer bearing member and the second developer bearing member; and a controller configured to execute a control mode including both a first mode and a second mode to drive the first developer bearing member and the second developer bearing member during a non-image forming period, wherein the controller is configured to control a drive of the first developer bearing member and the second developer bearing member so that the first developer bearing member and the second developer bearing member are driven in the first mode, and the controller is configured to control the developing bias and a potential of the image bearing member in the first mode so that a sign of a value of the DC component of the developing bias in the first mode minus the potential of the image bearing member in the first mode and a sign of a value of the DC component of the developing bias in an image forming period minus the potential of the image bearing member at a non-image forming area in the image forming period are the same, and so that a first potential difference between the DC component of the developing bias in the first mode and the potential of the image bearing member in the first mode is larger than a second potential difference between the DC component of the developing bias in the image forming period and the potential of the image bearing member at the non-image forming area in the image forming period, wherein the controller is configured to control a drive of the first developer bearing member and the second developer bearing member in the second mode so that the first developer bearing member rotates at a circumferential velocity faster than a circumferential velocity of the second developer bearing member, and the controller is configured to control the DC component of the developing bias in the second mode so as to be zero.

* * * * *